US012116870B2

(12) United States Patent
Newton

(10) Patent No.: US 12,116,870 B2
(45) Date of Patent: Oct. 15, 2024

(54) ENHANCED EXPANDABLE LINER HANGER SUPPORT MECHANISM

(71) Applicant: Halliburton Energy Services, Inc., Houston, TX (US)

(72) Inventor: Daniel Newton, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 134 days.

(21) Appl. No.: 18/076,559

(22) Filed: Dec. 7, 2022

(65) Prior Publication Data

US 2024/0191605 A1 Jun. 13, 2024

(51) Int. Cl.
*E21B 43/10* (2006.01)

(52) U.S. Cl.
CPC ..... *E21B 43/105* (2013.01); *E21B 43/103* (2013.01)

(58) Field of Classification Search
CPC ..... E21B 43/105; E21B 43/103
See application file for complete search history.

(56) References Cited

U.S. PATENT DOCUMENTS 11,136,850 B2 * 10/2021 Wellhoefer ..... C09K 8/5086
11,697,915 B2 * 7/2023 Greci ..... E02D 5/40 405/228
2014/0174763 A1 6/2014 Zhong et al.
2018/0363428 A1 12/2018 Rice
2020/0362224 A1 11/2020 Wellhoefer et al.
2021/0189830 A1 * 6/2021 Greci ..... E21B 33/1212
2021/0332659 A1 * 10/2021 Fripp ..... E21B 33/1208
2022/0325600 A1 * 10/2022 Fripp ..... E21B 33/1216
2022/0381108 A1 * 12/2022 Murphy ..... F16J 15/068
2023/0407718 A1 * 12/2023 Least ..... E21B 33/128

FOREIGN PATENT DOCUMENTS

WO 2010147999 A2 12/2010
WO 2022146419 A1 7/2022

* cited by examiner

*Primary Examiner* — Jonathan Malikasim
(74) *Attorney, Agent, or Firm* — Scott Richardson; Parker Justiss, P.C.

(57) ABSTRACT

Provided is a liner hanger, a method, and a well system. The liner hanger, in one aspect, includes a liner hanger body having an expansion section movable from a radially unexpanded state to a radially expanded state in contact with an inside diameter (ID) of a wellbore tubular. The liner hanger may further include a support assembly coupled to the liner hanger body, the support assembly including a support housing, and a mechanical support structure positioned radially inside of the support housing. In one aspect, the mechanical support structure is movable from a first position radially misaligned with the expansion section when the expansion section is in the radially unexpanded state to a second position at least partially radially aligned with the expansion section when the expansion section is in the radially expanded state. The liner hanger, in one aspect, further includes expandable metal coupled to the mechanical support structure.

38 Claims, 22 Drawing Sheets

ENHANCED EXPANDABLE LINER HANGER SUPPORT MECHANISM

BACKGROUND

Wellbores are often drilled through one or more subterranean formations for the purpose of collecting downhole hydrocarbons. In some instances, a portion of the wellbore may be cased, for example by placing, and typically cementing, a casing into the wellbore. A tubing string may then be run in and out of the casing. Alternatively, the tubing string may be run in and out of any uncased portion of the wellbore as well.

In some operations, a liner may be suspended from the casing string with a liner hanger. The liner hanger anchors to the interior of the casing string and suspends the liner below the casing string. In this aspect, the liner hanger and liner do not extend to the surface, for example as the casing string does. The liner hanger also forms a seal with the casing string, thereby preventing fluid there between. Thus, the fluid flow is directed through the interior of the liner instead.

BRIEF DESCRIPTION

Reference is now made to the following descriptions taken in conjunction with the accompanying drawings, in which.

DETAILED DESCRIPTION

Figure 1:
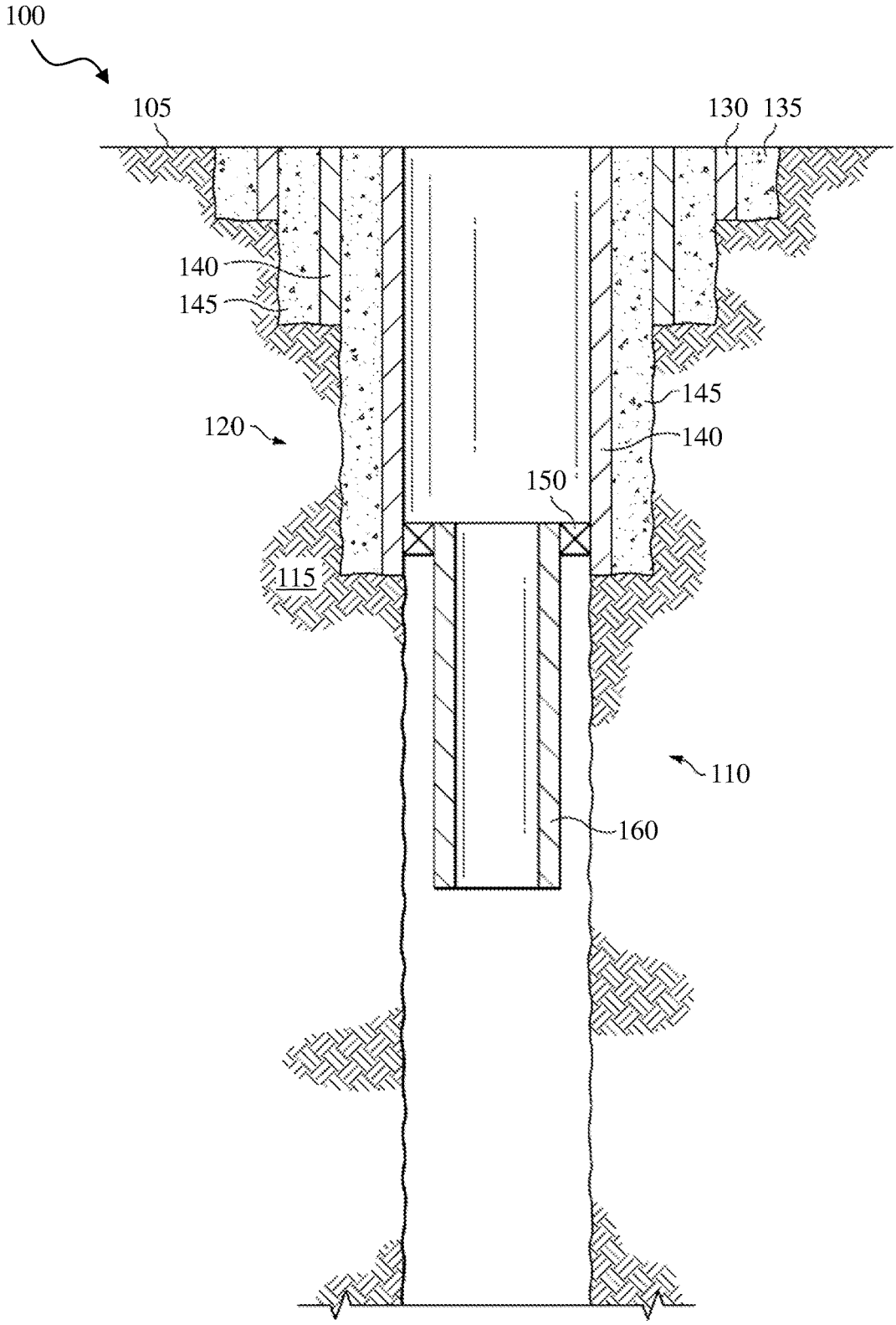
FIG. 1, illustrates a schematic of an example well system designed, manufactured and/or operated according to one or more embodiments of the disclosure.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described. Unless otherwise specified, use of the terms "up," "upper." "upward," "uphole," "upstream," or other like terms shall be construed as generally away from the bottom, terminal end of a well; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical axis. Unless otherwise specified, use of the term "subterranean formation" shall be construed as encompassing both areas below exposed earth and areas below earth covered by water such as ocean or fresh water.

Traditional liner hangers (e.g., traditional expandable liner hangers) rely upon one or more sealing elements (e.g., a series of metal ribs), or the body of the liner hanger itself, to contact the wellbore tubular inside diameter (ID) (e.g., casing string ID). The contact between the liner hanger itself and the wellbore tubular ID may be used to hold the load of the liner, as well as address any pressure differential there across, all of which directly relates to the contact pressure between the two. Unfortunately, downhole pressure applied to the liner hanger attempts to displace the wellbore tubular ID radially outward (e.g., away from the liner hanger), as well as compress the liner hanger radially inward (e.g., away from the wellbore tubular ID), both of which may reduce the contact pressure between the liner hanger and the wellbore tubular ID. In certain high-pressure applications, the downhole pressure may be great enough to dislodge the liner hanger from the casing ID, or at least large enough to reduce the contact pressure to a value that provides an undesirable fluid path therebetween.

Based on the foregoing problems, the present disclosure has developed an improved liner hanger that is able to maintain a sufficient amount of contact pressure between the liner hanger and the wellbore tubular ID, even with the increased downhole pressure associated with those high-pressure applications. For example, one embodiment of the improved liner hanger includes a mechanical support structure that is movable underneath an expansion section of the liner hanger body, the mechanical support structure providing additional internal force against the expansion section, as well as the one or more sealing elements (e.g., if used). The mechanical support structure additionally restrains the expansion section, as well as the one or more sealing elements (e.g., if used), from compressing radially inward in those high-pressure applications.

In at least one embodiment, the mechanical support structure is a sliding sleeve. For example, upon successful expansion of the expansion section of the liner hanger body, the sliding sleeve could be shifted to be at least partially radially aligned with the expansion section. The sliding sleeve would, thus, provide the additional internal force, as well as resist compression of the liner hanger body, as discussed above.

In at least one embodiment, the sliding sleeve could include an expandable metal, the expandable metal comprising a metal configured to expand in response to hydrolysis, thus resulting in an expanded metal support structure. Accordingly, after the mechanical support structure has slid, the expandable metal would react with a reactive fluid, and subsequently expand to fill a gap between an outside diameter (OD) of the mechanical support structure and an ID of the liner hanger body.

The term expandable metal, as used herein, refers to the expandable metal in a pre-expansion form. Similarly, the term expanded metal, as used herein, refers to the resulting expanded metal after the expandable metal has been subjected to reactive fluid, as discussed below. The expanded metal, in accordance with one or more aspects of the disclosure, comprises a metal that has expanded in response to hydrolysis. In certain embodiments, the expanded metal includes residual unreacted metal. For example, in certain embodiments the expanded metal is intentionally designed to include the residual unreacted metal. The residual unreacted metal has the benefit of allowing the expanded metal to self-heal if cracks or other anomalies subsequently arise, or for example to accommodate changes in the tubular or mandrel diameter due to variations in temperature and/or pressure. Nevertheless, other embodiments may exist wherein no residual unreacted metal exists in the expanded metal.

The expandable metal, in some embodiments, may be described as expanding to a cement like material. In other words, the expandable metal goes from metal to micron-scale particles and then these particles expand and lock together to, in essence, seal two or more surfaces together. The reaction may, in certain embodiments, occur in less than 2 days in a reactive fluid and in certain temperatures. Nevertheless, the time of reaction may vary depending on the reactive fluid, the expandable metal used, the downhole temperature, and surface-area-to-volume ratio (SA:V) of the expandable metal.

In some embodiments, the reactive fluid may be a brine solution such as may be produced during well completion activities, and in other embodiments, the reactive fluid may be one of the additional solutions discussed herein. The expandable metal is electrically conductive in certain embodiments. The expandable metal, in certain embodiments, has a yield strength greater than about 8,000 psi, e.g., 8,000 psi+/−50%.

The hydrolysis of the expandable metal can create a metal hydroxide. The formative properties of alkaline earth metals (Mg—Magnesium, Ca—Calcium, etc.) and transition metals (Zn—Zinc, Al—Aluminum, etc.) under hydrolysis reactions demonstrate structural characteristics that are favorable for use with the present disclosure. Hydration results in an increase in size from the hydration reaction and results in a metal hydroxide that can precipitate from the fluid.

It should be noted that the starting expandable metal, unless otherwise indicated, is not a metal oxide (e.g., an insulator). In contrast, the starting expandable metal has the properties of traditional metals: 1) Highly conductive to both electricity and heat (e.g., greater than 1,000,000 siemens per meter); 2) Contains a metallic bond (e.g., the outermost electron shell of each of the metal atoms overlaps with a large number of neighboring atoms). As a consequence, the valence electrons are allowed to move from one atom to another and are not associated with any specific pair of atoms. This gives metals their conductive nature; 3) Are malleable and ductile, for example deforming under stress without cleaving; and 4) Tend to be shiny and lustrous with high density.

The hydration reactions for magnesium is:

$$Mg+2H_2O \rightarrow Mg(OH)_2+H_2,$$

where $Mg(OH)_2$ is also known as brucite. Another hydration reaction uses aluminum hydrolysis. The reaction forms a material known as Gibbsite, bayerite, boehmite, aluminum oxide, and norstrandite, depending on form. The possible hydration reactions for aluminum are:

$$Al+3H_2O \rightarrow Al(OH)_3+3/2H_2.$$

$$Al+2H_2O \rightarrow Al\ O(OH)+3/2H_2$$

$$Al+3/2H_2O \rightarrow 1/2Al_2O_3+3/2H_2$$

Another hydration reaction uses calcium hydrolysis. The hydration reaction for calcium is:

$$Ca+2H_2O \rightarrow Ca(OH)_2+H_2,$$

Where $Ca(OH)_2$ is known as portlandite and is a common hydrolysis product of Portland cement. Magnesium hydroxide and calcium hydroxide are considered to be relatively insoluble in water. Aluminum hydroxide can be considered an amphoteric hydroxide, which has solubility in strong acids or in strong bases. Alkaline earth metals (e.g., Mg. Ca, etc.) work well for the expandable metal, but transition metals (Al, etc.) also work well for the expandable metal. In one embodiment, the metal hydroxide is dehydrated by the swell pressure to form a metal oxide.

In at least one embodiment, the expandable metal is a non-graphene based expandable metal. By non-graphene based material, it is meant that is does not contain graphene, graphite, graphene oxide, graphite oxide, graphite intercalation, or in certain embodiments, compounds and their derivatized forms to include a function group, e.g., including carboxy, epoxy, ether, ketone, amine, hydroxy, alkoxy, alkyl, aryl, aralkyl, alkaryl, lactone, functionalized polymeric or oligomeric groups, or a combination comprising at least one of the forgoing functional groups. In at least one other embodiment, the expandable metal does not include a matrix material or an exfoliatable graphene-based material. By not being exfoliatable, it means that the expandable metal is not able to undergo an exfoliation process. Exfoliation as used herein refers to the creation of individual sheets, planes, layers, laminae, etc. (generally, "layers") of a graphene-based material; the delamination of the layers; or the enlargement of a planar gap between adjacent ones of the layers, which in at least one embodiment the expandable metal is not capable of.

In yet another embodiment, the expandable metal does not include graphite intercalation compounds, wherein the graphite intercalation compounds include intercalating agents such as, for example, an acid, metal, binary alloy of an alkali metal with mercury or thallium, binary compound of an alkali metal with a Group V element (e.g., P, As, Sb, and Bi), metal chalcogenide (including metal oxides such as, for example, chromium trioxide, $PbO_2$, $MnO_2$, metal sulfides, and metal selenides), metal peroxide, metal hyperoxide, metal hydride, metal hydroxide, metals coordinated by nitrogenous compounds, aromatic hydrocarbons (benzene, toluene), aliphatic hydrocarbons (methane, ethane, ethylene, acetylene, n-hexane) and their oxygen derivatives, halogen, fluoride, metal halide, nitrogenous compound, inorganic compound (e.g., trithiazyl trichloride, thionyl chloride), organometallic compound, oxidizing compound (e.g., peroxide, permanganate ion, chlorite ion, chlorate ion, perchlorate ion, hypochlorite ion, $As_2O_5$, $N_2O_5$, $CH_{3D}lO_4$, $(NH_4)_2S_2O_8$, chromate ion, dichromate ion), solvent, or a combination comprising at least one of the foregoing. Thus, in at least one embodiment, the expandable metal is a structural solid expanded metal, which means that it is a metal that does not exfoliate and it does not intercalate. In yet another embodiment, the expandable metal does not swell by sorption.

In an embodiment, the expandable metal used can be a metal alloy. The expandable metal alloy can be an alloy of the base expandable metal with other elements in order to either adjust the strength of the expandable metal alloy, to adjust the reaction time of the expandable metal alloy, or to adjust the strength of the resulting metal hydroxide byproduct, among other adjustments. The expandable metal alloy can be alloyed with elements that enhance the strength of the metal such as, but not limited to, Al—Aluminum, Zn—Zinc, Mn—Manganese, Zr—Zirconium, Y—Yttrium, Nd—Neodymium, Gd—Gadolinium, Ag—Silver, Ca—Calcium, Sn—Tin, and Re—Rhenium, Cu—Copper. In some embodiments, the expandable metal alloy can be alloyed with a dopant that promotes corrosion, such as Ni—Nickel, Fe—Iron, Cu—Copper, Co—Cobalt, Ir—Iridium, Au—Gold, C—Carbon, Ga—Gallium, In—Indium, Mg—Mercury, Bi—Bismuth, Sn—Tin, and Pd—Palladium. The expandable metal alloy can be constructed in a solid solution process where the elements are combined with molten metal or metal alloy. Alternatively, the expandable metal alloy could be constructed with a powder metallurgy process. The expandable metal can be cast, forged, extruded, sintered, welded, mill machined, lathe machined, stamped, eroded or a combination thereof. The metal alloy can be a mixture of the metal and metal oxide. For example, a powder mixture of aluminum and aluminum oxide can be ball-milled together to increase the reaction rate.

Optionally, non-expanding components may be added to the starting metallic materials. For example, ceramic, elastomer, plastic, epoxy, glass, or non-reacting metal components can be embedded in the expandable metal or coated on the surface of the expandable metal. In yet other embodiments, the non-expanding components are metal fibers, a composite weave, a polymer ribbon, or ceramic granules, among others. In one variation, the expandable metal is formed in a serpentinite reaction, a hydration and metamorphic reaction. In one variation, the resultant material resembles a mafic material. Additional ions can be added to the reaction, including silicate, sulfate, aluminate, carbonate, and phosphate. The metal can be alloyed to increase the reactivity or to control the formation of oxides.

The expandable metal can be configured in many different fashions, as long as an adequate volume of material is available for supporting the necessary features. For example, the expandable metal may be formed into a single long member, multiple short members, rings, among others. In another embodiment, the expandable metal may be formed into a long wire of expandable metal, that can be in turn be wound around a mandrel as a sleeve. The wire diameters do not need to be of circular cross-section, but may be of any cross-section. For example, the cross-section of the wire could be oval, rectangle, star, hexagon, keystone, hollow braided, woven, twisted, among others, and remain within the scope of the disclosure. In certain other embodiments, the expandable metal is a collection of individual separate chunks of the metal held together with a binding agent. In yet other embodiments, the expandable metal is a collection of individual separate chunks of the metal that are not held together with a binding agent, but held in place using one or more different techniques, including an enclosure (e.g., an enclosure that could be crushed to expose the individual separate chunks to the reactive fluid), a cage, etc.

Additionally, a delay coating or protective layer may be applied to one or more portions of the expandable metal to delay the expanding reactions. In one embodiment, the material configured to delay the hydrolysis process is a fusible alloy. In another embodiment, the material configured to delay the hydrolysis process is a eutectic material. In yet another embodiment, the material configured to delay the hydrolysis process is a wax, oil, or other non-reactive material. The delay coating or protective layer may be applied to any of the different expandable metal configurations disclosed above.

Turning to FIG. 1, illustrated is a schematic of an example well system 100 designed, manufactured and/or operated according to one or more embodiments of the disclosure. The well system 100, in the illustrated embodiment, includes a wellbore 110 extending from a surface 105 and penetrating a subterranean formation 115. In the illustrated embodiment, the well system 100 includes a tubing system 120 located within the wellbore 110, the tubing system 120 designed, manufactured and/or operated according to one or more aspects of the disclosure. The tubing system 120, in one aspect, includes surface casing 130 and surface cement sheath 135 descending from the surface 105. In the illustrated embodiment, the tubing system 120 additionally includes multiple layers of intermediate casing 140 and intermediate cement sheaths 145 that are deployed and nested concentrically within the surface casing 130. In some examples, only one layer of intermediate casing 140 may be used, but in other embodiments two or more layers of intermediate casing 140 may be used. In some other examples, a shallow well may be drilled which may not employ a layer of intermediate casing 140.

In the illustrated embodiment, a liner hanger 150 is deployed within the innermost intermediate casing 140, the liner hanger 150 designed, manufactured and/or operated according to one or more embodiments of the disclosure. The liner hanger 150 may be used to suspend a liner 160 from within the previous casing (e.g., innermost intermediate casing 140). The liner 160 may be any conduit suitable for suspension within the wellbore 110. The liner 160, in one or more embodiments, is a conduit that does not run to the surface 105 (e.g., unlike the intermediate casing strings 140). The liner hanger 150 seals within the intermediate casing 140, allowing the liner 160 to functionally act as an extension of the intermediate casing 140.

Figure 2:
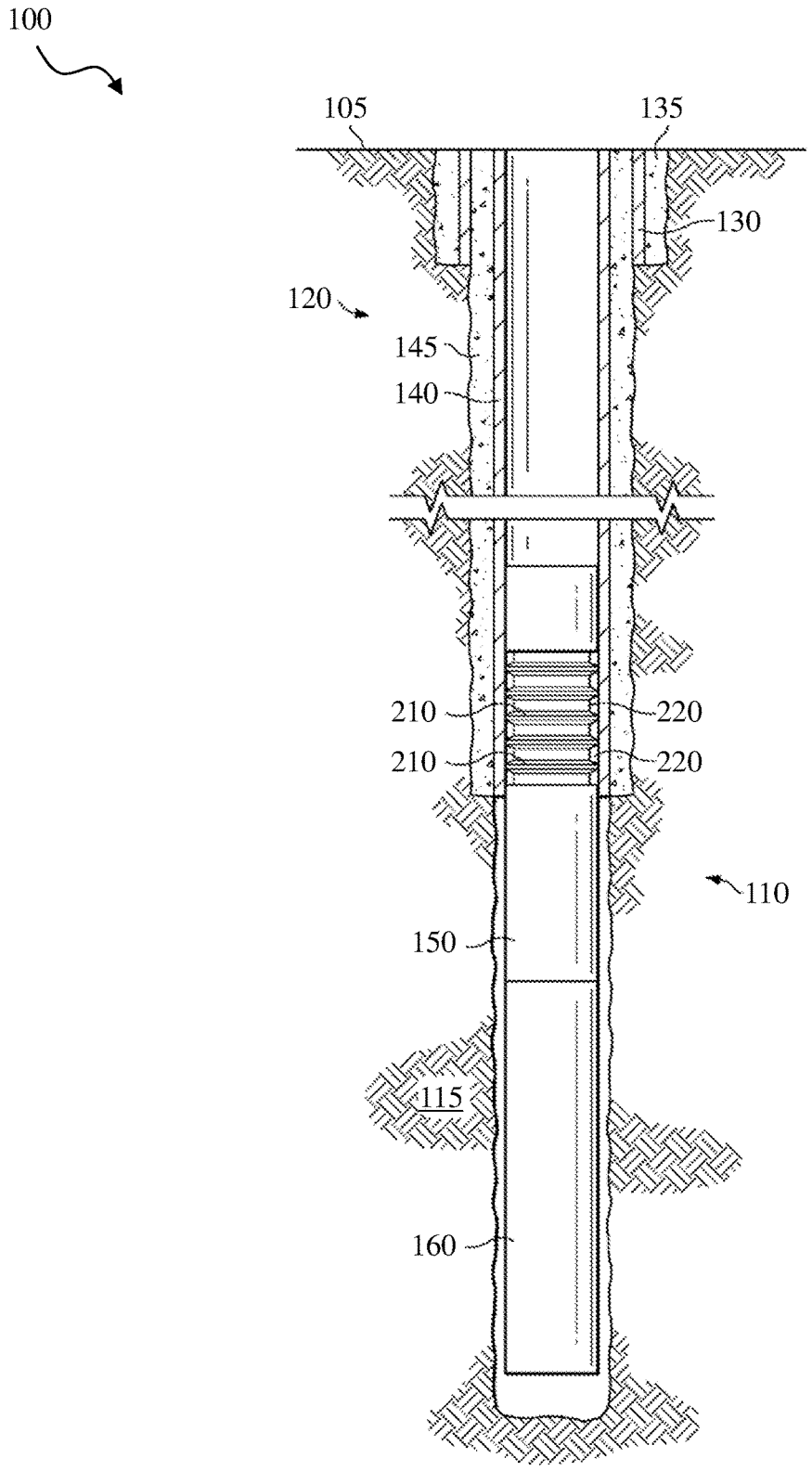
FIG. 2 illustrates an enlarged cross-section illustration of the well system of FIG. 1.

Turning to FIG. 2, illustrated is an enlarged cross-section illustration of the well system 100 of FIG. 1. In the embodiment of FIG. 2, the tubing system 120 functions as a conduit for the wellbore 110 that penetrates subterranean formation 115. The tubing system 120 comprises surface casing 130 and surface cement sheath 135 that anchors the surface casing 130 in the wellbore 110. The surface casing 130 extends from the surface 105 down to a desired depth in the wellbore 110. Intermediate casing 140 is deployed concentrically within surface casing 130. Intermediate casing 140 may be held in place within the surface casing 130 with an intermediate cement sheath 145. Although only one layer of intermediate casing 140 is illustrated, it is to be understood that as many layers of intermediate casing 140 may be used as desired. Any subsequent layers of the intermediate casing 140 may be nested concentrically within one another within the illustrated intermediate casing 140.

The liner hanger 150 is deployed within the intermediate casing 140. The liner hanger 150 suspends a liner 160 from its end. The liner hanger 150 is anchored to the intermediate casing 140 with a one or more sealing elements 210 (e.g., a series of sealing elements), such as metal ribs. The sealing elements 210 form external seals with the adjacent interior surface of the intermediate casing 140. The formed seals prevent wellbore fluid from bypassing the liner 160 and liner hanger 150. In one or more embodiments, space 220 exists between ones of the one or more sealing elements 210.

It should be clearly understood that the examples illustrated by FIGS. 1-2 are merely general applications of the principles of this disclosure in practice, and a wide variety of other examples are possible. Therefore, the scope of this disclosure is not limited in any manner to the details of any of the FIGs. described herein.

Turning to FIGS. 3A through 3D, illustrated are various different embodiments of a liner hanger 300 (e.g., as might be used for suspending a liner) designed, manufactured and/or operated according to one or more embodiments of the disclosure. The liner hanger 300, in one or more embodiments, includes a liner hanger body 310, as well as a support assembly 330 and a deployment body 380 coupled to the liner hanger body 310. In the illustrated embodiment, the liner hanger body 310 is positioned uphole of the deployment body 380, and the support assembly 330 is positioned between the liner hanger body 310 and the deployment body 380. Nevertheless, other embodiments may exist wherein the liner hanger body 310, support assembly 330 and/or deployment body 380 of the liner hanger 300 are placed in different configurations.

The liner hanger body 310, in one embodiment, includes an expansion section 315 configured to move from a radially unexpanded state (e.g., as shown in FIGS. 3A through 3D) to a radially expanded state (e.g., not shown) in contact with an ID of a wellbore tubular. In the illustrated embodiment of FIGS. 3A through 3D, the expansion section 315 includes one or more scaling elements 320 (e.g., a series of sealing elements) positioned radially thereabout. In this embodiment, the one or more sealing elements 320 are configured to contact the ID of the wellbore tubular (e.g., casing string) when the expansion section 315 moves (e.g., is plastically deformed) to the radially expanded state. The one or more sealing elements 320, in one or more embodiments, may include one or more metal ribs positioned radially about the liner hanger body 310. Any number of scaling elements 320 may be used and remain within the scope of the disclosure. Nevertheless, in one embodiment the number of sealing elements 320 ranges from 2 to 8. Furthermore, certain embodiments may exist wherein no sealing elements 320 are employed, and thus the liner hanger body 310 itself is plastically deformed to contact the ID of the wellbore tubular.

The support assembly 330, in one or more embodiments, includes a support housing 335. The support housing 335, in at least one embodiment, couples (e.g., directly couples) to the liner hanger body. For example, in at least one embodiment the support housing 335 directly couples to a downhole end of the liner hanger body 310 using threads (e.g., acme threads in one embodiment).

The support housing 335, in one or more embodiments, may further include one or more support housing profiles 340. In the illustrated embodiment of FIGS. 3A through 3D, the support housing 335 includes a downhole support housing profile 340*a* and an uphole support housing profile 340*b*. Nevertheless, other embodiments may exist wherein the support housing 335 only includes one of the downhole support housing profile 340*a* or the uphole support housing profile 340*b*.

Figure 3A:
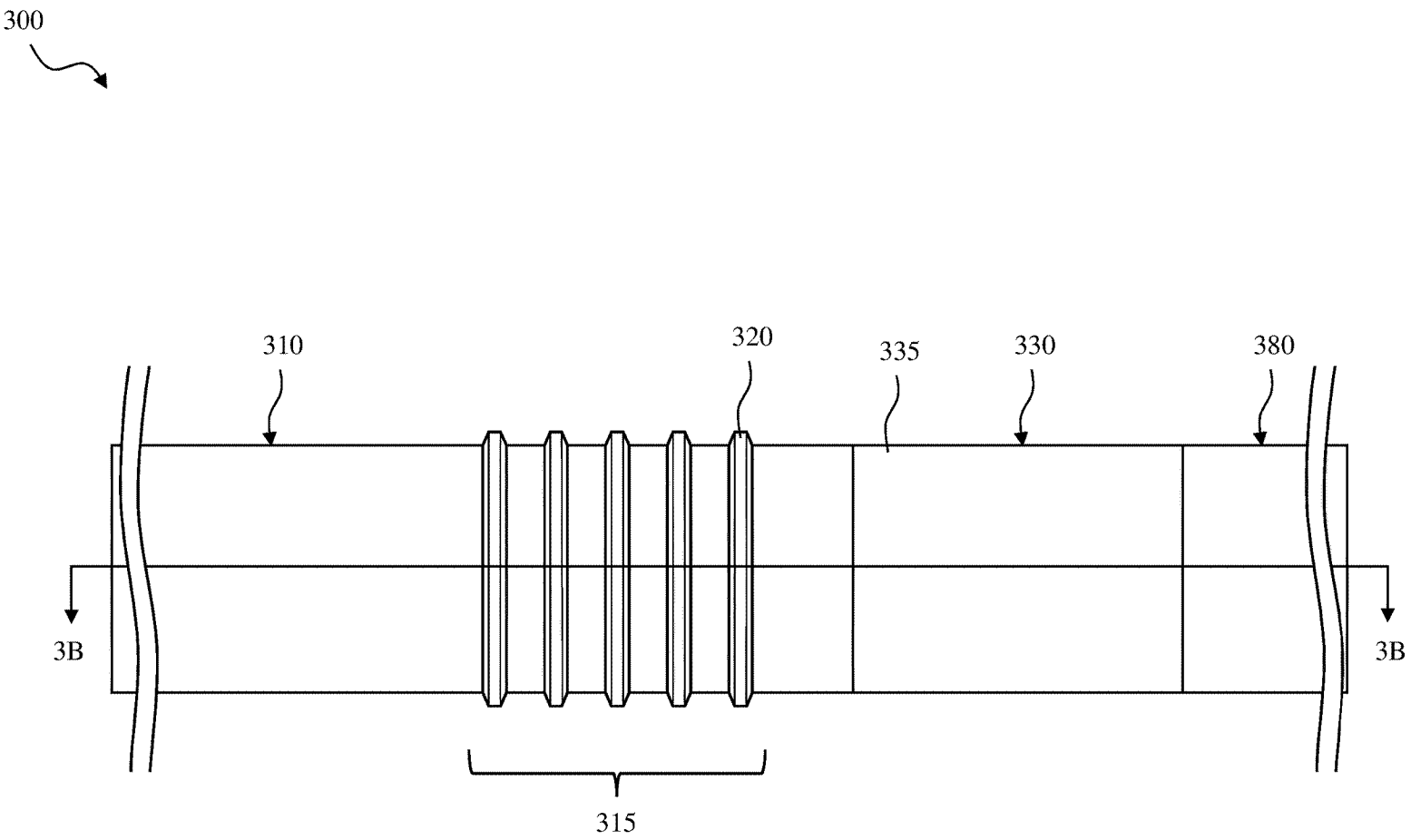
FIGS. 3A through 3D illustrate various different embodiments of a liner hanger (e.g., as might be used for suspending a liner) designed, manufactured and/or operated according to one or more embodiments of the disclosure.
Figure 3B:
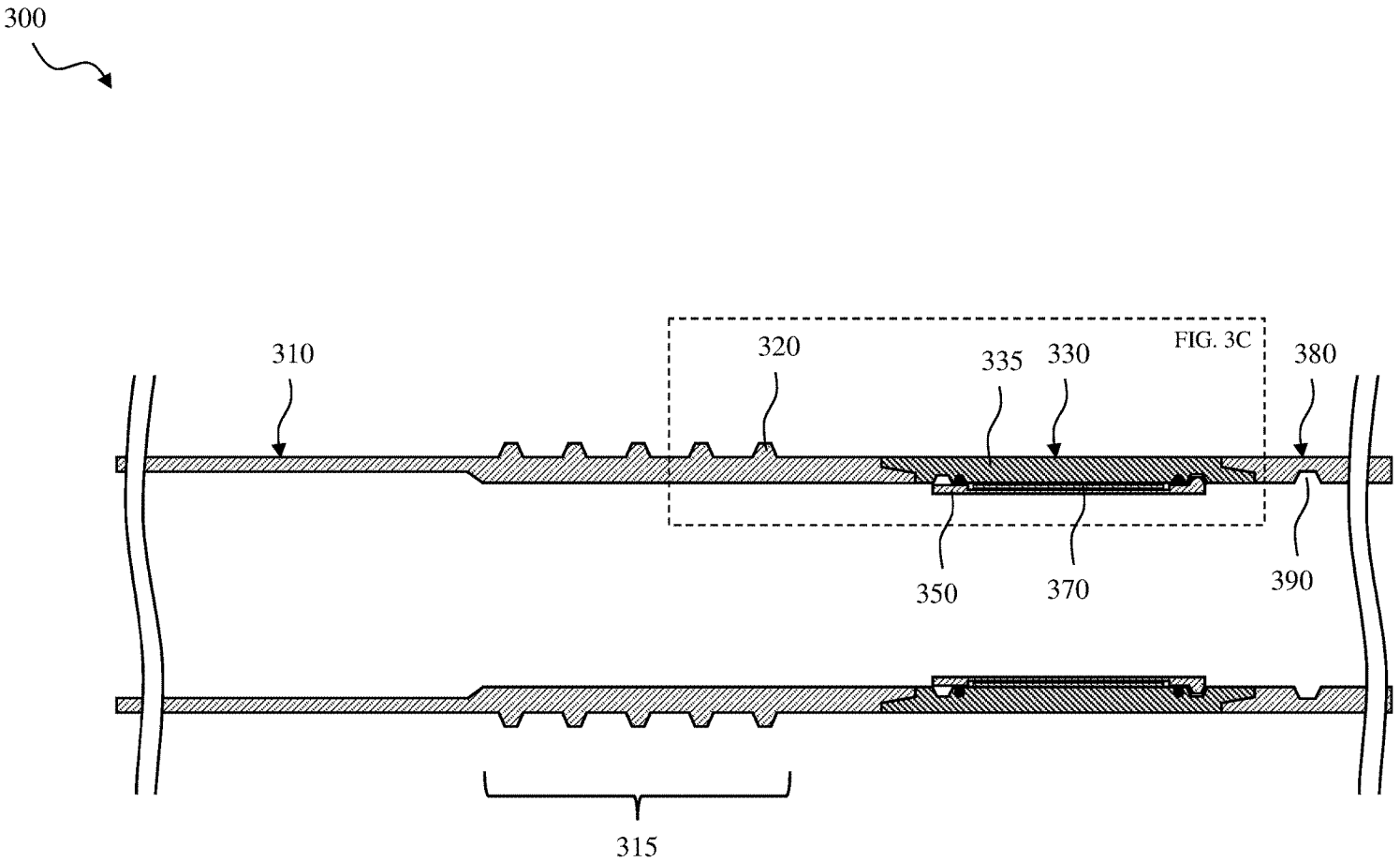
Figure 3C:
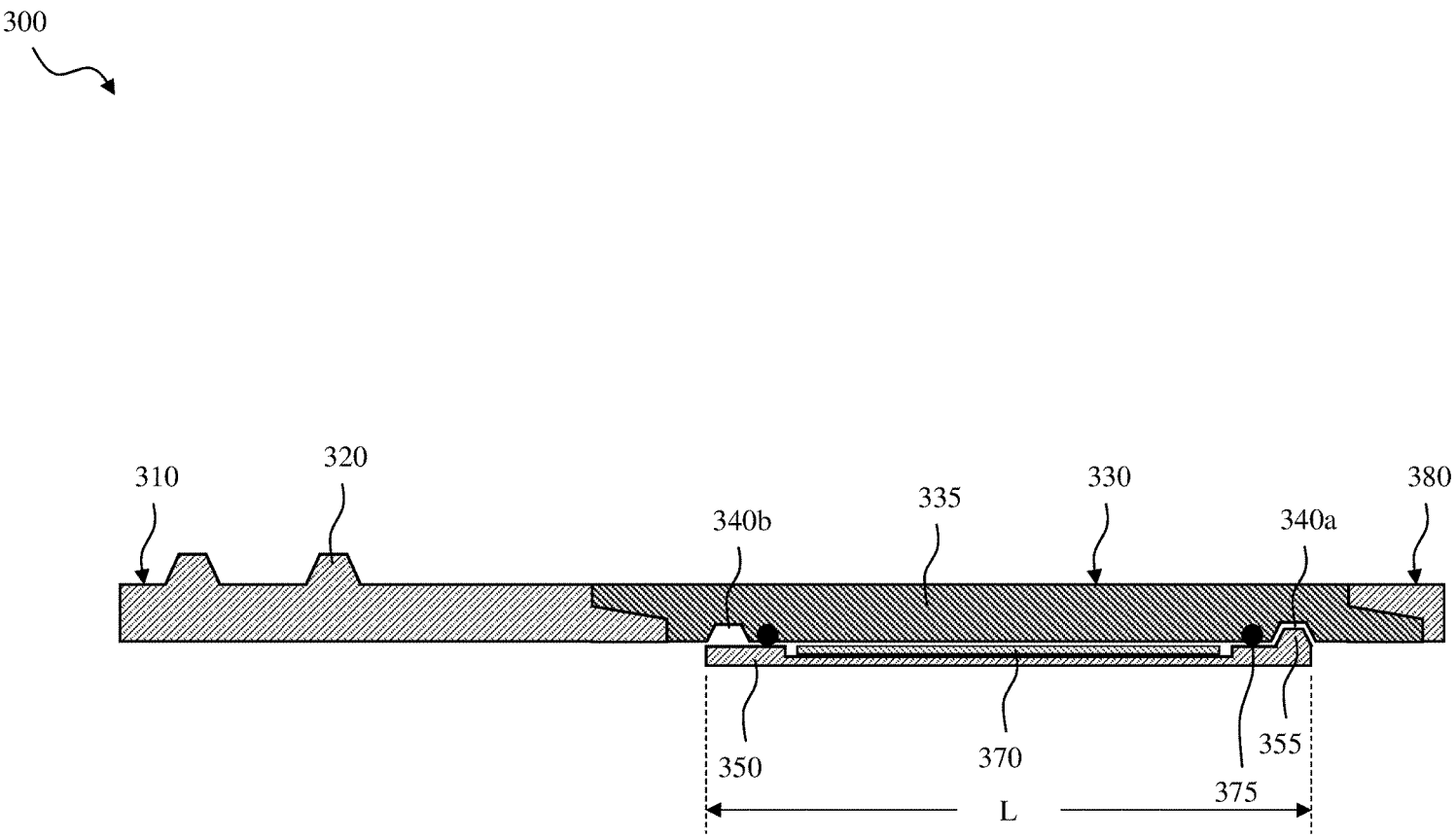
Figure 3D:
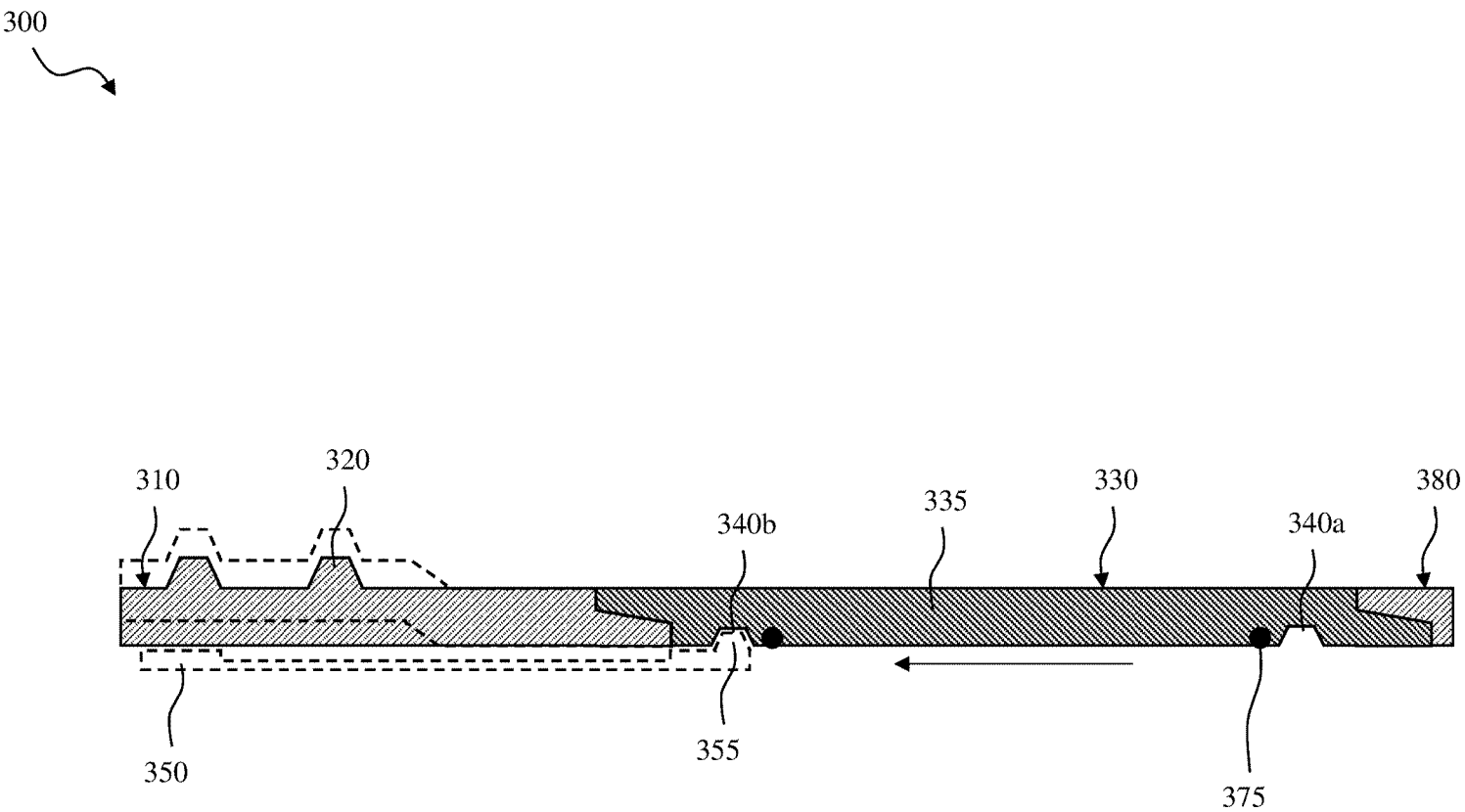

The support assembly 330, in one or more other embodiments, may further include a mechanical support structure 350 positioned radially inside of the support housing 335. In accordance with at least one embodiment, the mechanical support structure 350 is movable from a first position radially misaligned with the expansion section 315 (e.g., as shown in FIG. 3C) when the expansion section 315 is in the radially unexpanded state to a second position at least partially radially aligned with the expansion section 315 (e.g., as shown in FIG. 3D) when the expansion section 315 is in the radially expanded state. In at least one embodiment, the mechanical support structure 350 is radially misaligned with an entirety of the liner hanger body 310 when in the first position.

In at least one embodiment, the first position of the mechanical support structure 350 is radially misaligned with the one or more sealing elements 320, and the second position of the mechanical support structure 350 is radially aligned with at least one of the one or more sealing elements 320. In at least one other embodiment, the first position of the mechanical support structure 350 is radially misaligned with the one or more sealing elements 320, and the second position of the mechanical support structure 350 is radially aligned with at least two of the one or more sealing elements 320. In yet at least one other embodiment, the first position of the mechanical support structure 350 is radially misaligned with the one or more sealing elements 320, and the second position of the mechanical support structure 350 is radially aligned with all of the one or more sealing elements 320. Essentially, a length (L) of the mechanical support structure 350, along with its sliding distance, may be tailored to slide and support any amount of the liner hanger body 310 and/or any number of the one or more sealing elements 320 (e.g., depending on the amount of additional structural support needed).

The mechanical support structure 350, in at least one embodiment, further includes a support structure positioning profile 355, the support structure positioning profile 355 configured to help movably fix the mechanical support structure 350 in the first position and/or the second position. For example, the support structure position profile 355, which is a collet, snap ring, etc. in one embodiment, could engage with the one or more support housing profiles 340 of the support housing 335 to movably fix the mechanical support structure 350 in the first position or the second position. Accordingly, in at least the embodiment of FIGS. 3A through 3D, the support structure position profile 355 would engage with the downhole support housing profile 340*a* to movably fix the mechanical support structure 350 in the first position (e.g., as shown in FIG. 3C) and engage with the uphole support housing profile 340*b* to movably fix the mechanical support structure 350 in the second position (e.g., as shown in FIG. 3D).

The support assembly 330, in at least one other embodiment, may further include expandable metal 370 coupled to the mechanical support structure 350. In accordance with the disclosure, as well as the above paragraphs, the expandable metal 370 is configured to expand in response to hydrolysis to contact the ID of the liner hanger body 310 when the mechanical support structure 350 is in the second position. Accordingly, the post expansion expandable metal (e.g., expanded metal support structure) may be used to provide mechanical support to at least a portion of the expansion section 315 of the liner hanger body 310. In the example embodiment of FIGS. 3A through 3D, the expandable metal 370 is positioned within a recess 360 in the mechanical support structure 350.

The length, thickness and/or volume of the expandable metal 370 should be appropriately chosen to expand to fill a gap (g) that may exist between the OD of the mechanical support structure 350 and an ID of the expansion section 315 when in the radially expanded state. Accordingly, in at least one embodiment, the length, thickness and/or volume of the expandable metal 370 would need to fill a gap (g) no greater than 30 mm. In at least one embodiment, the length, thickness and/or volume of the expandable metal 370 would need to fill a gap (g) no greater than 20 mm, if not a gap (g) no greater than 10 mm, if not a gap (g) no greater than 6 mm, if not a gap (g) no greater than 4 mm. Moreover, the length of the expandable metal 370 may increase or decrease based upon the amount of the liner hanger body 310 the final expanded metal support structure is expected to support.

In at least one embodiment, one or more seals 375 are positioned radially between the support housing 335 and the mechanical support structure 350. The one or more seals 375, in at least one embodiment, are O-rings configured to isolate the expandable metal 370 from reactive fluid when the mechanical support structure 350 is in the first position, but allow the reactive fluid access to the expandable metal 370 when the mechanical support structure 350 is in the second position. In the illustrated embodiment, a pair of seals 375 are disposed on opposing sides of the expandable metal 370 when the mechanical support structure 350 is in the first position. Furthermore, while the embodiments of FIGS. 3A through 3D illustrate the pair of seals 375 embedded within seal bores of the support housing 335, other embodiments might have the seals 375 embedded within seal bores of the mechanical support structure 350.

The deployment body 380, in one or more embodiments, may include a deployment profile 390. The deployment profile 390, in one or more embodiments, may be configured to engage with a running tool profile (not shown) of a running tool (not shown), as will be further discussed below. As shown in the embodiment of FIGS. 3A through 3D, the deployment body couples (e.g., directly couples) to the support assembly 330. For example, in at least one embodiment the deployment body 380 directly couples to a downhole end of the support body 335 using threads (e.g., acme threads in one embodiment).

Figure 4A:
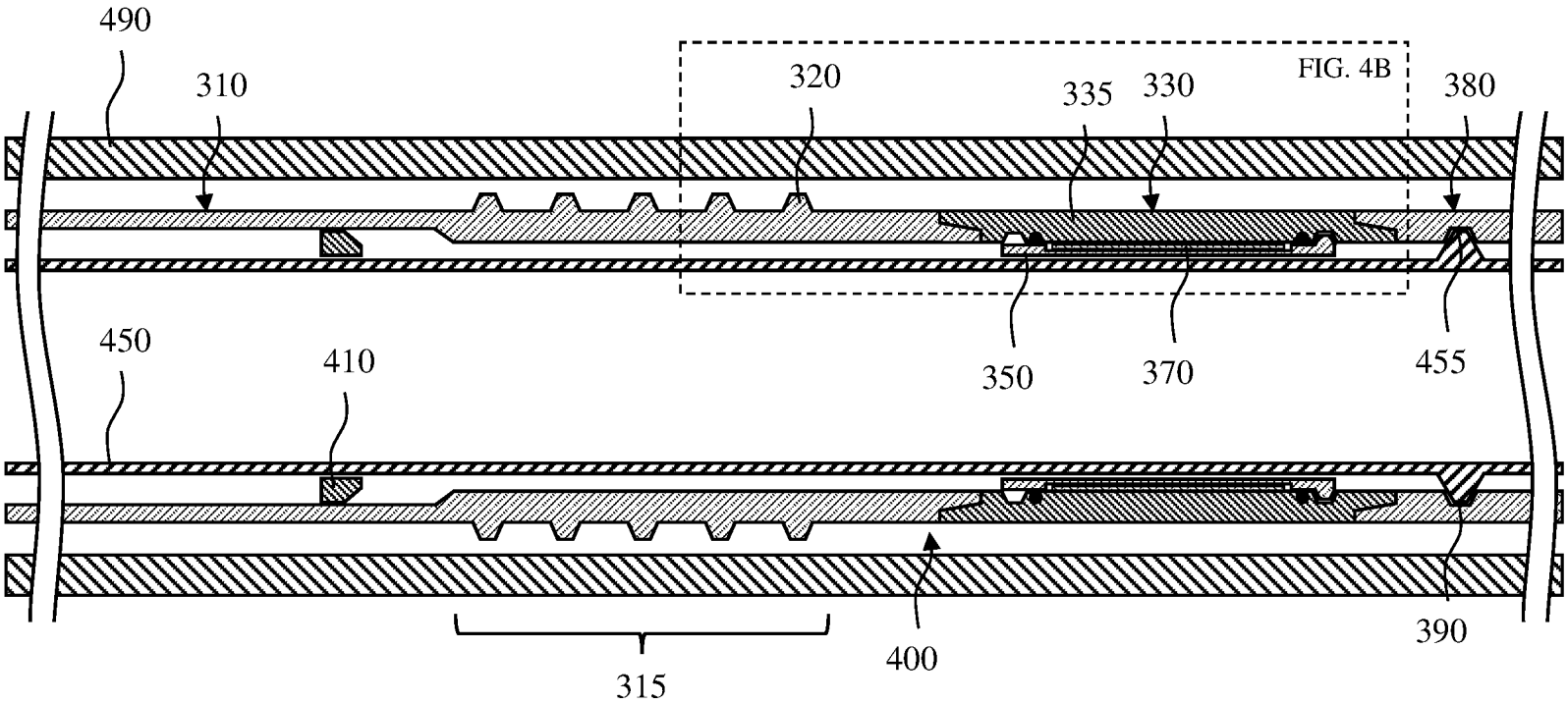
FIGS. 4A through 4P illustrated a method for deploying a liner hanger within a wellbore tubular according to one or more embodiments of the disclosure.
Figure 4B:
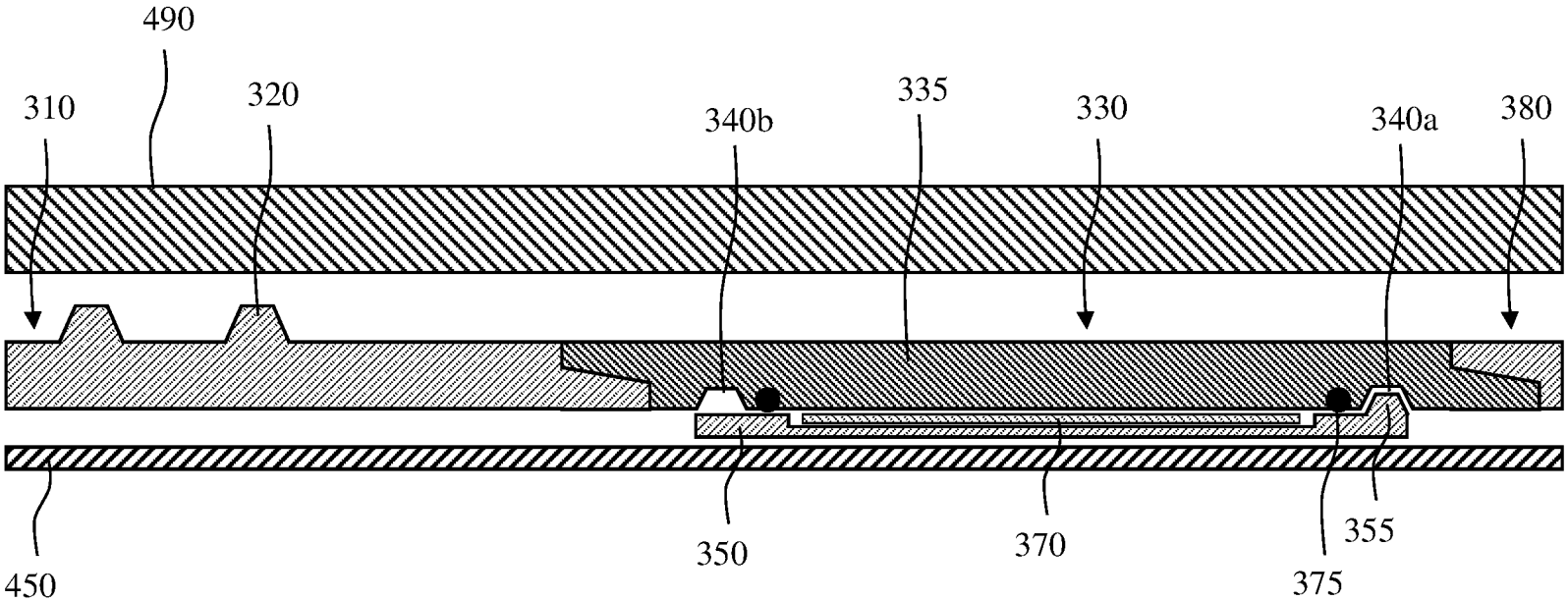
Figure 4C:
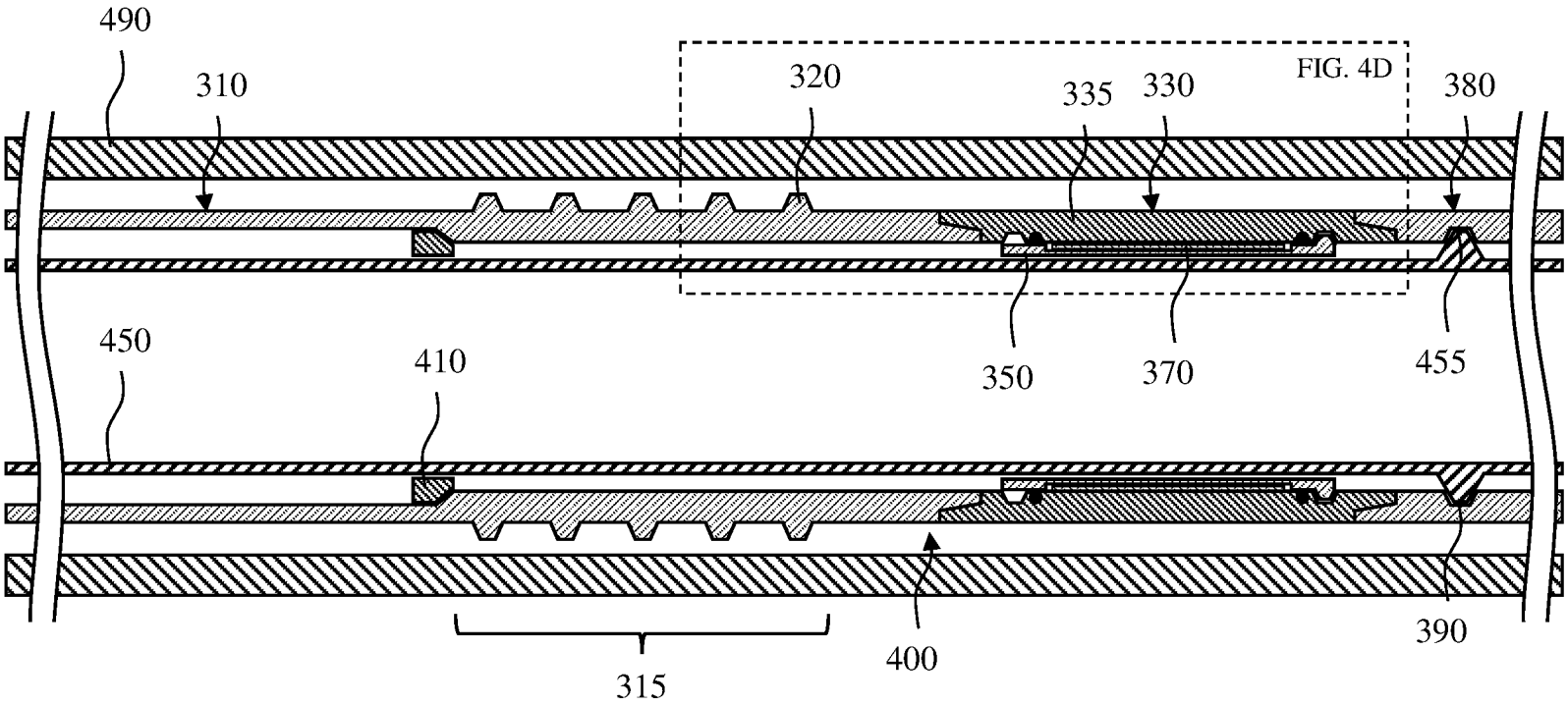
Figure 4D:
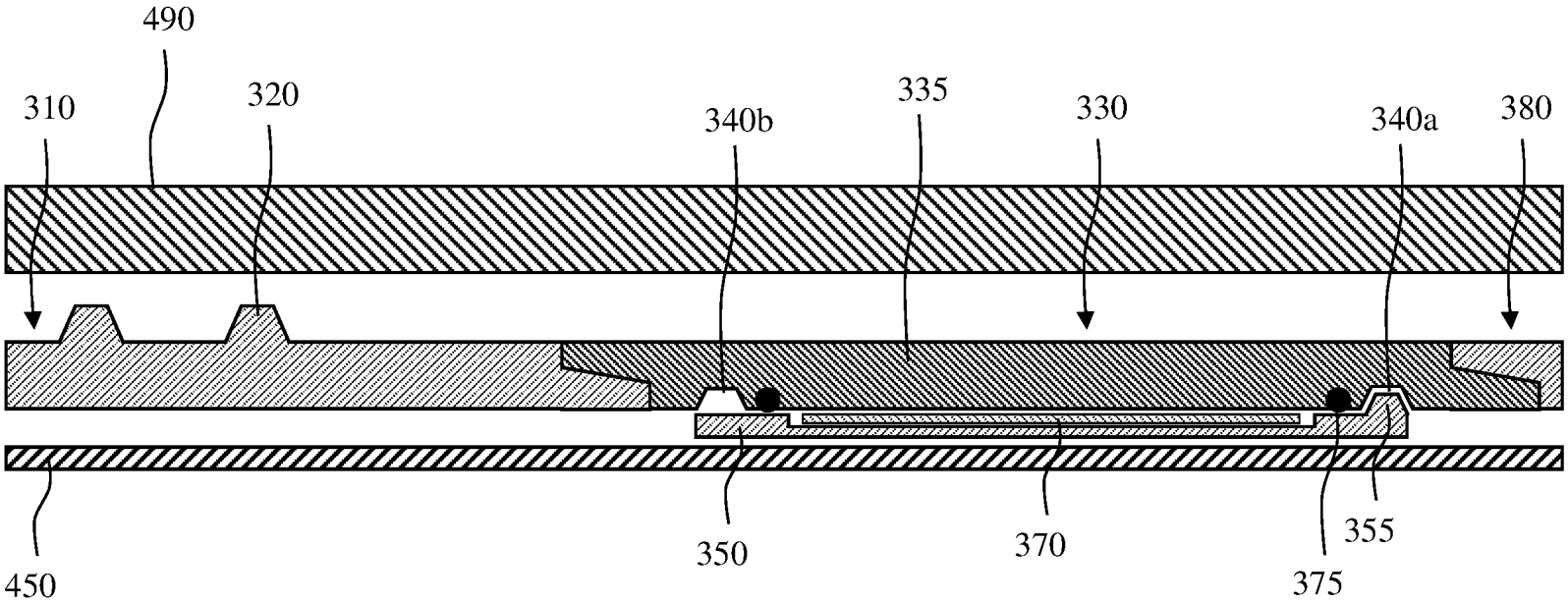
Figure 4E:
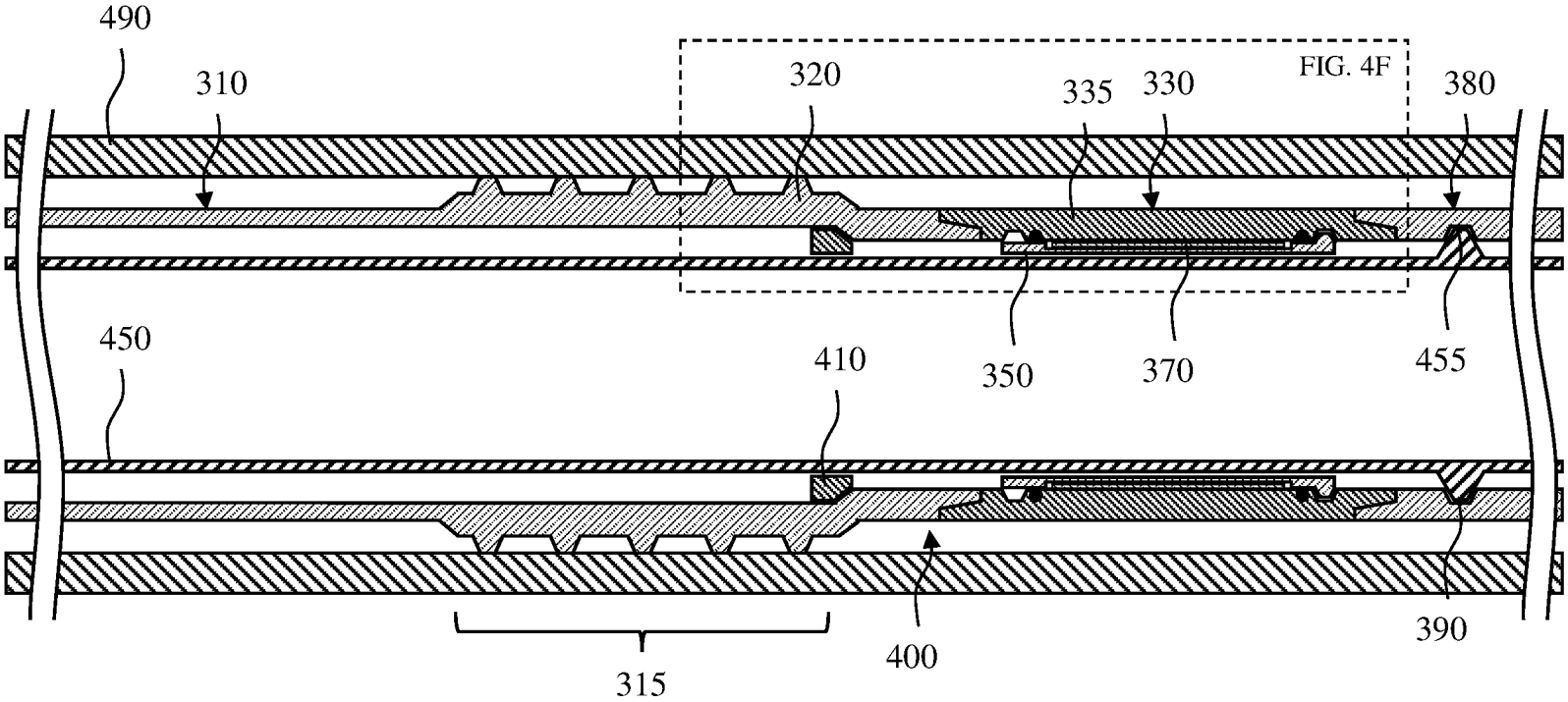
Figure 4F:
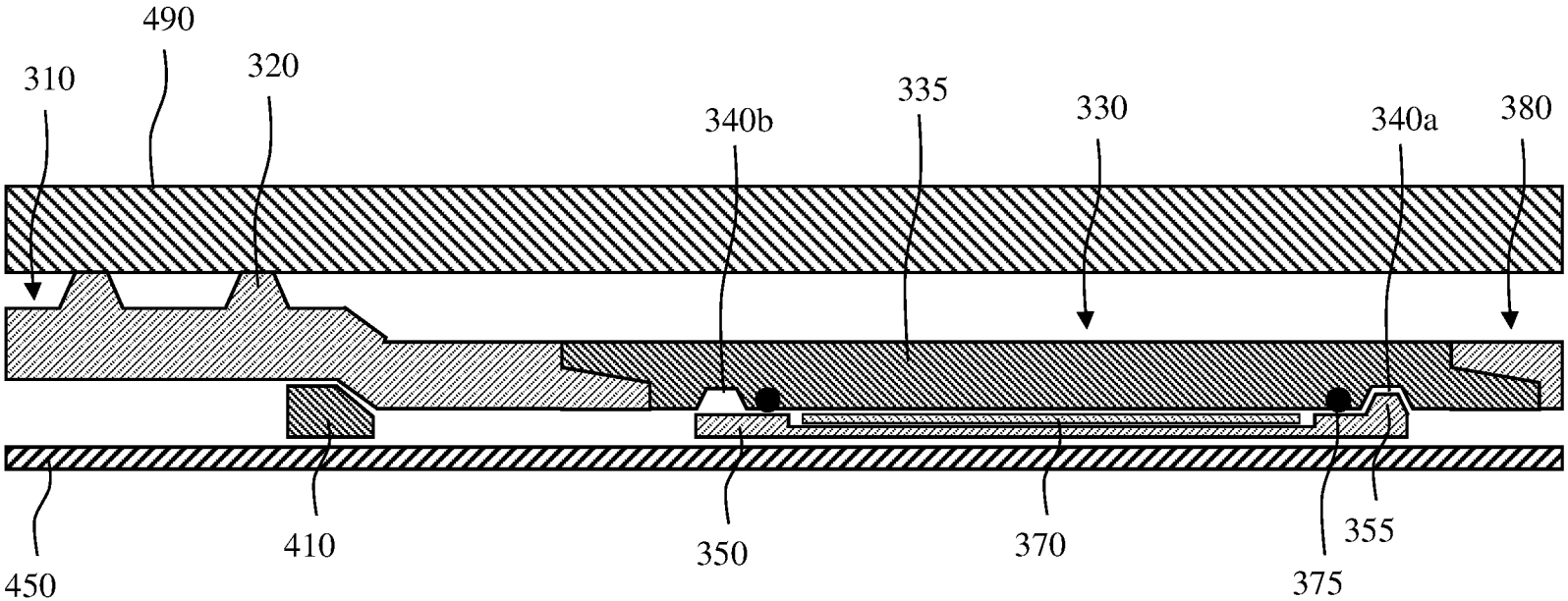
Figure 4G:
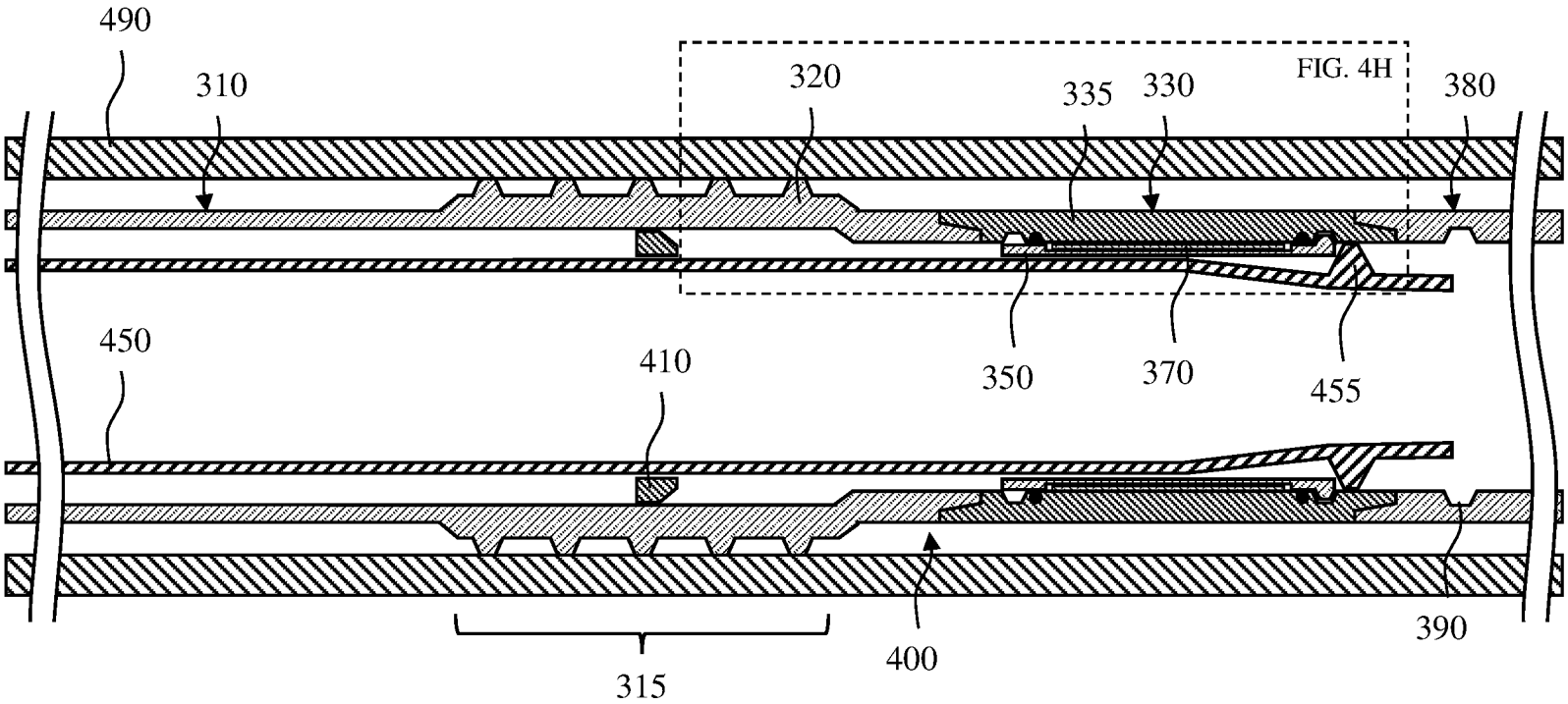
Figure 4H:
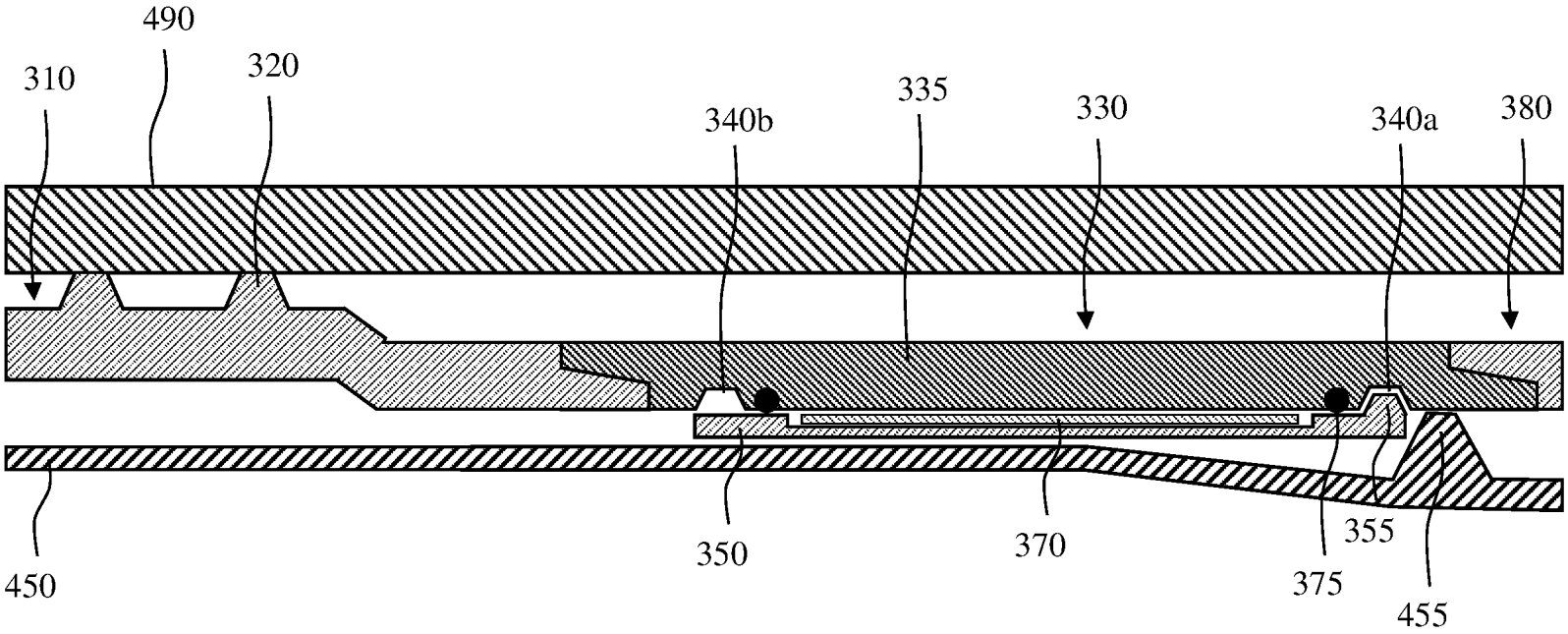
Figure 4I:
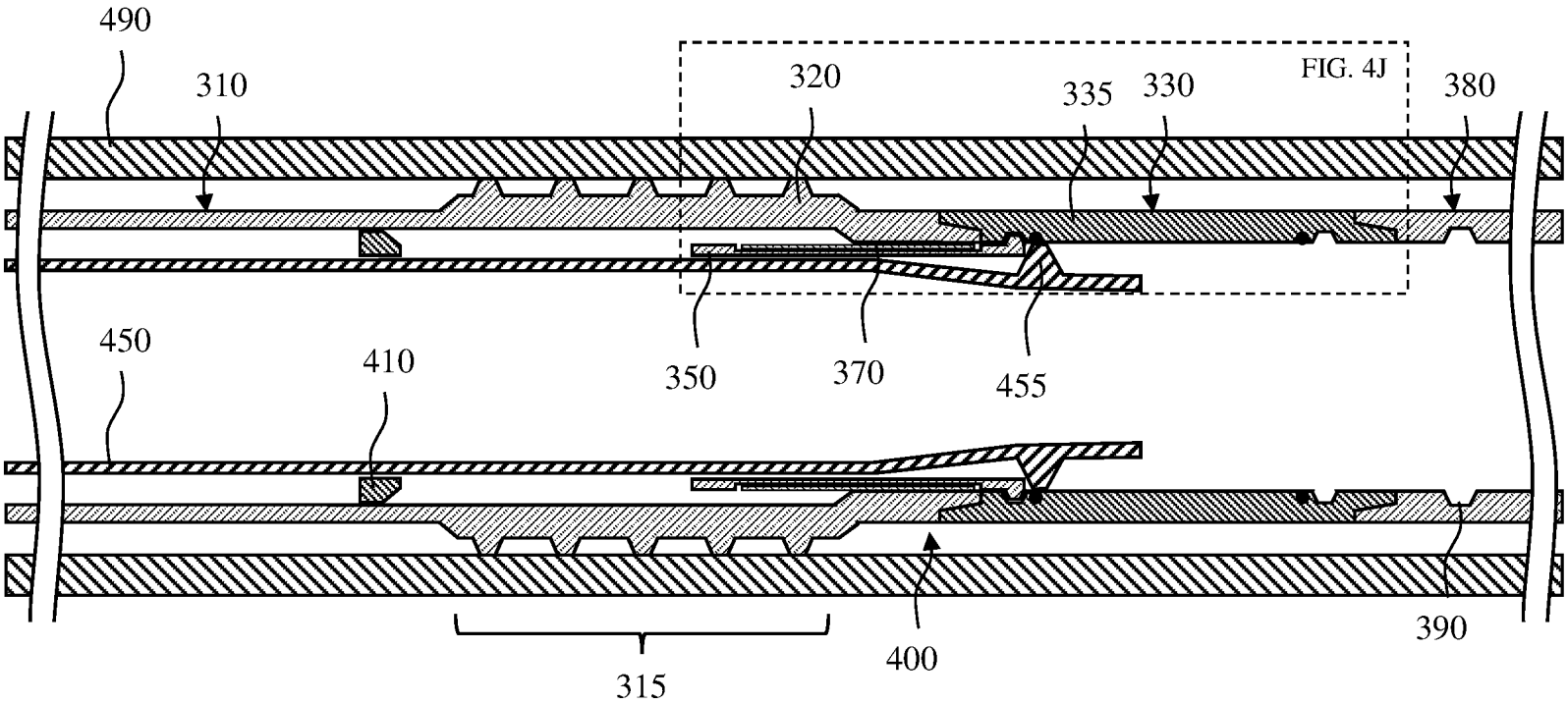
Figure 4J:
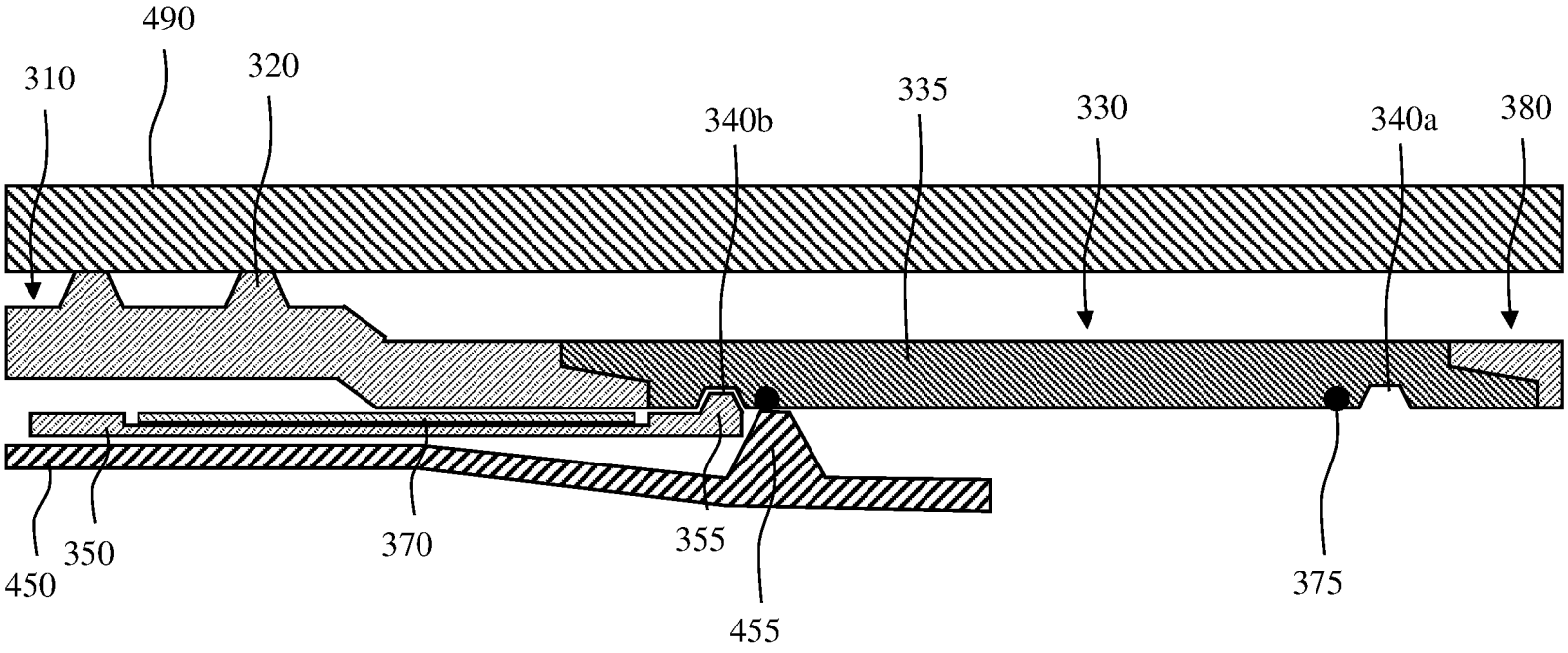
Figure 4K:
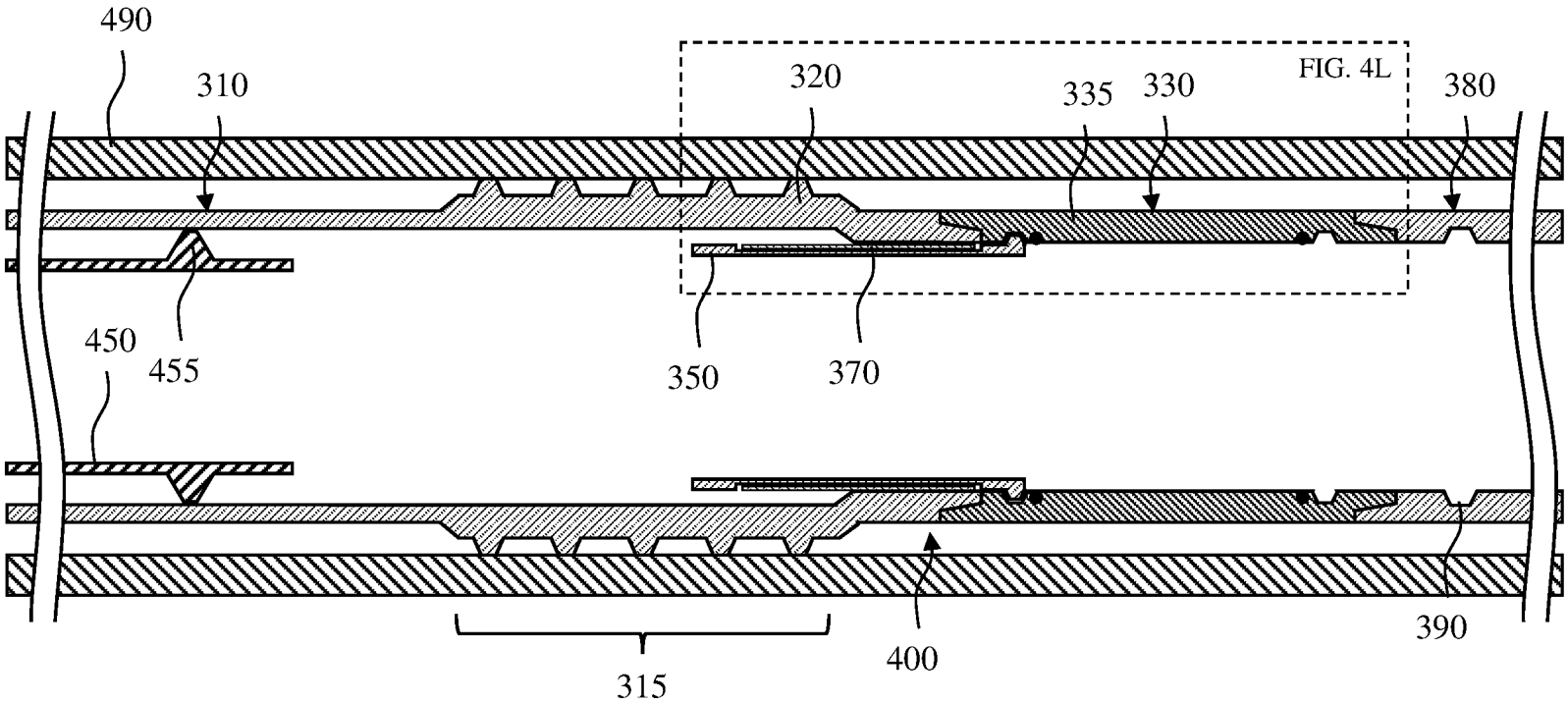
Figure 4L:
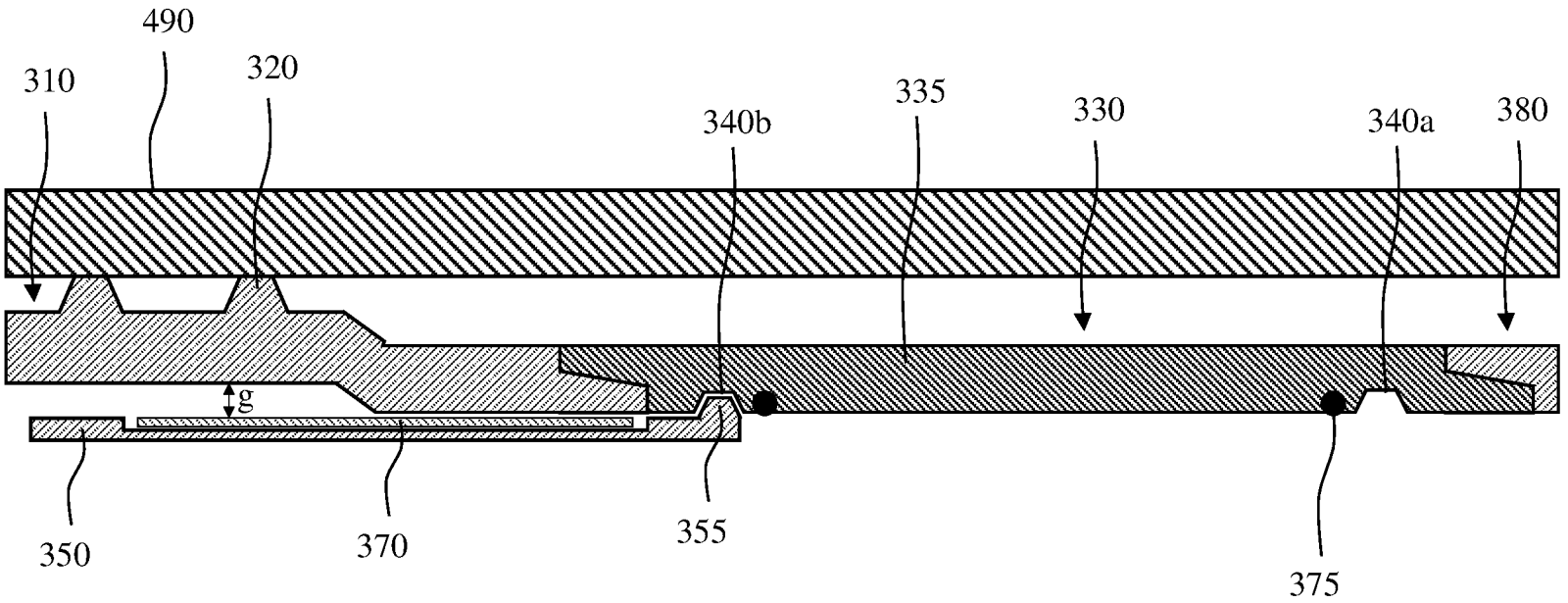
Figure 4M:
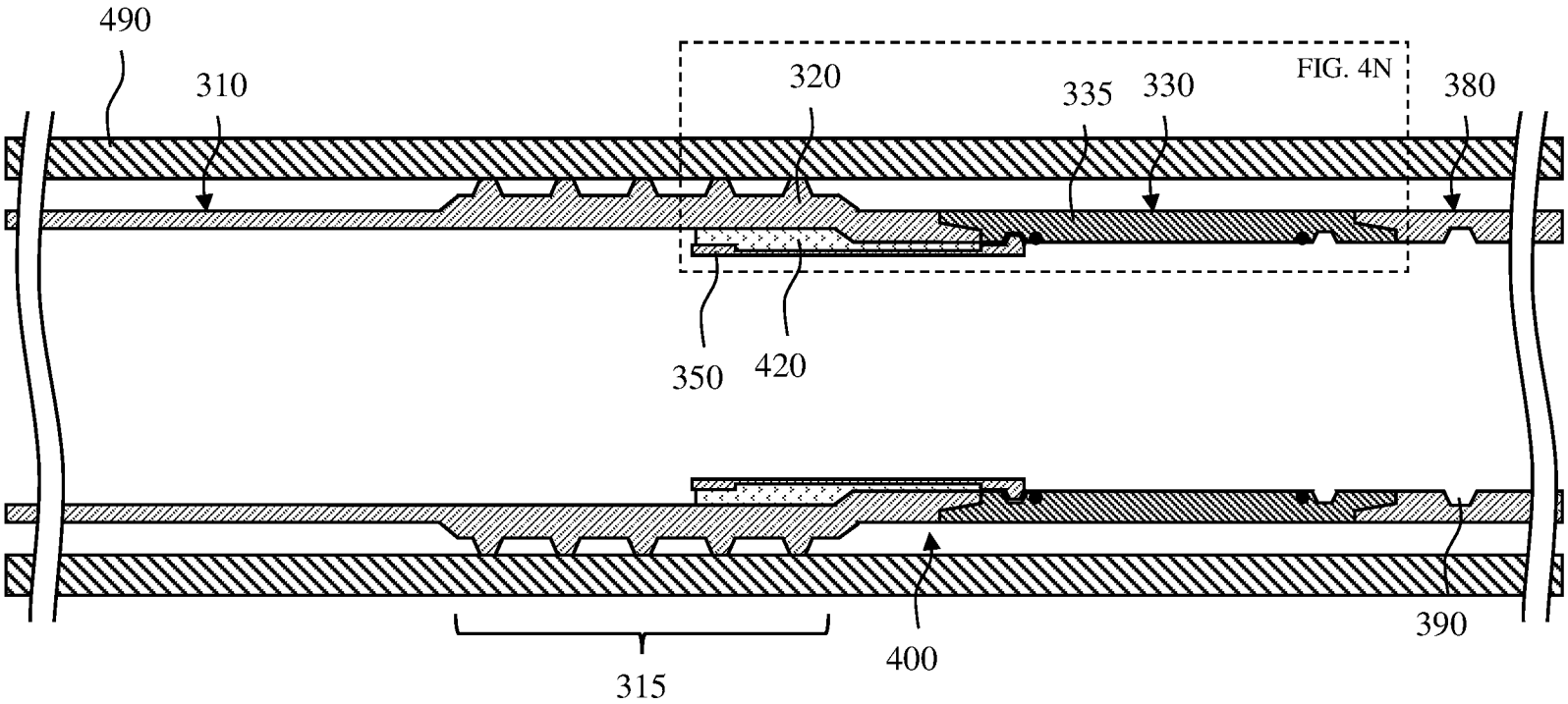
Figure 4N:
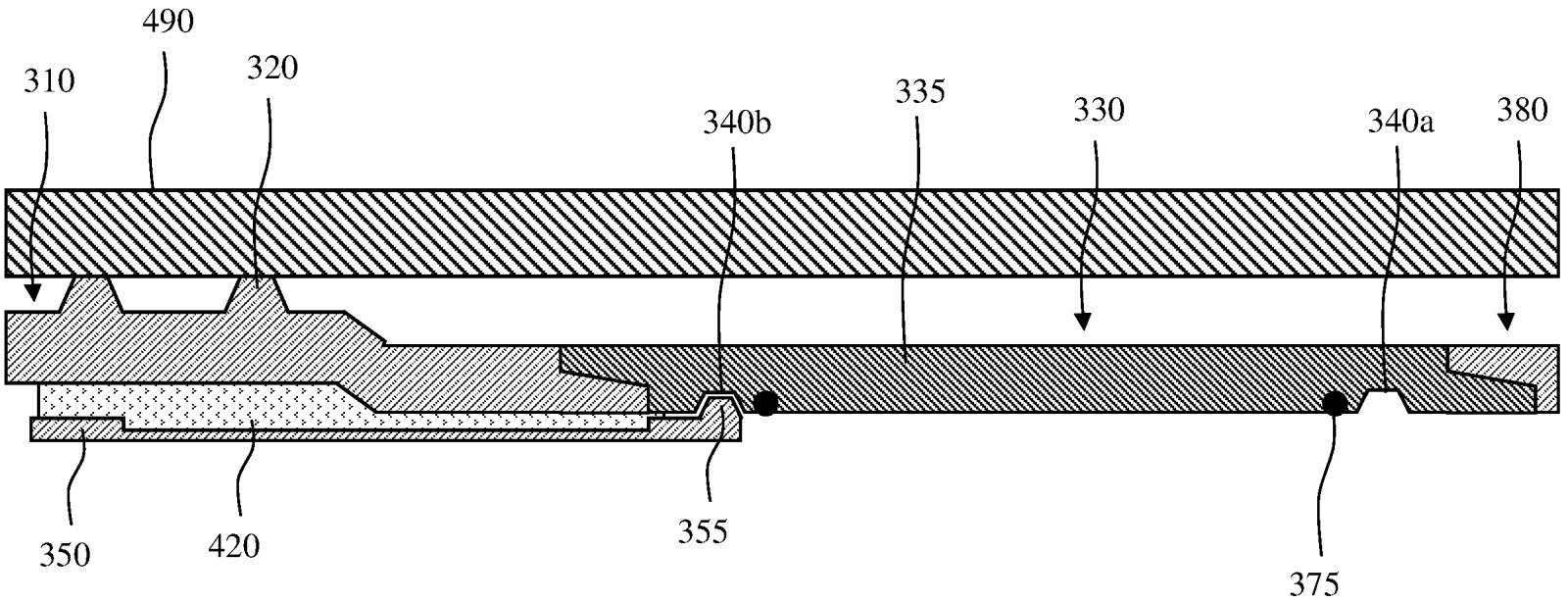
Figure 4O:
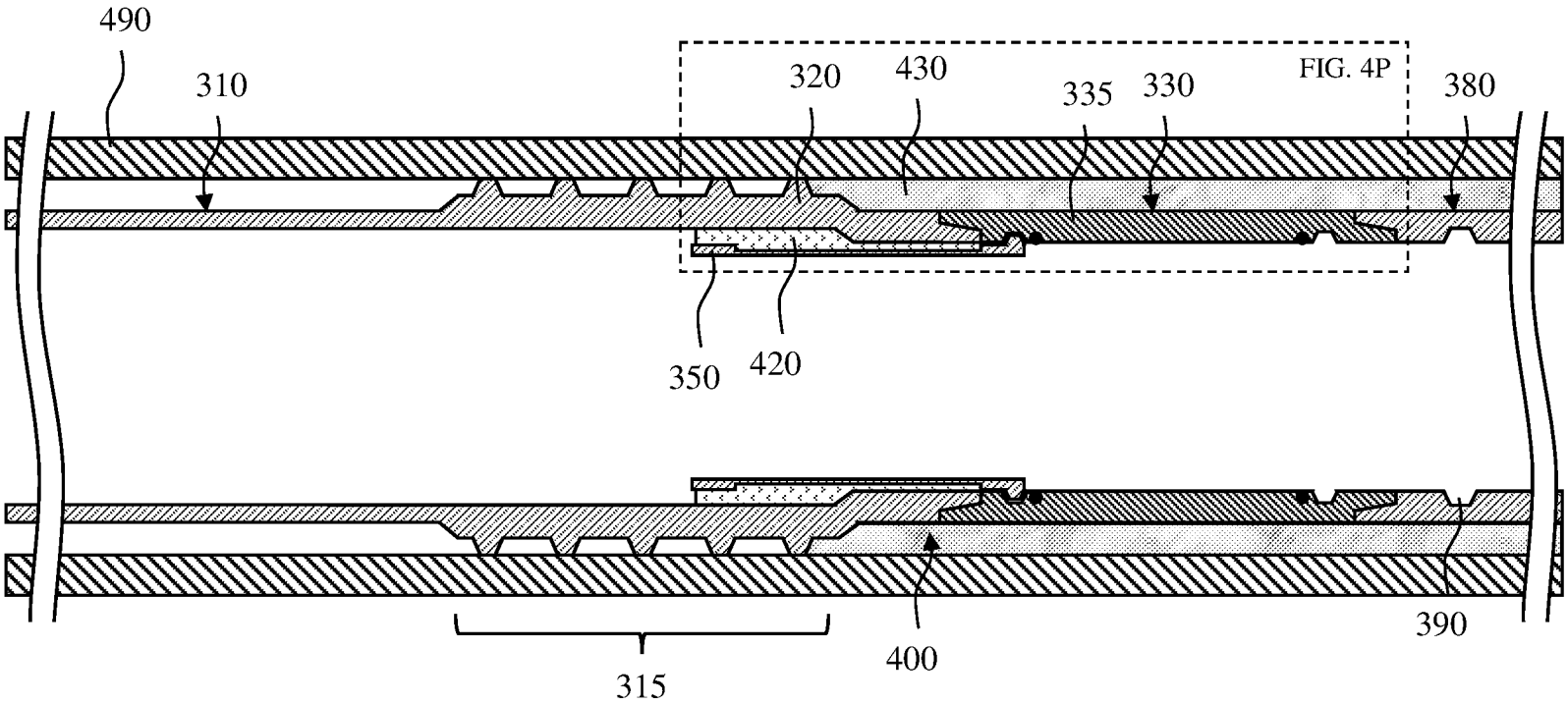
Figure 4P:
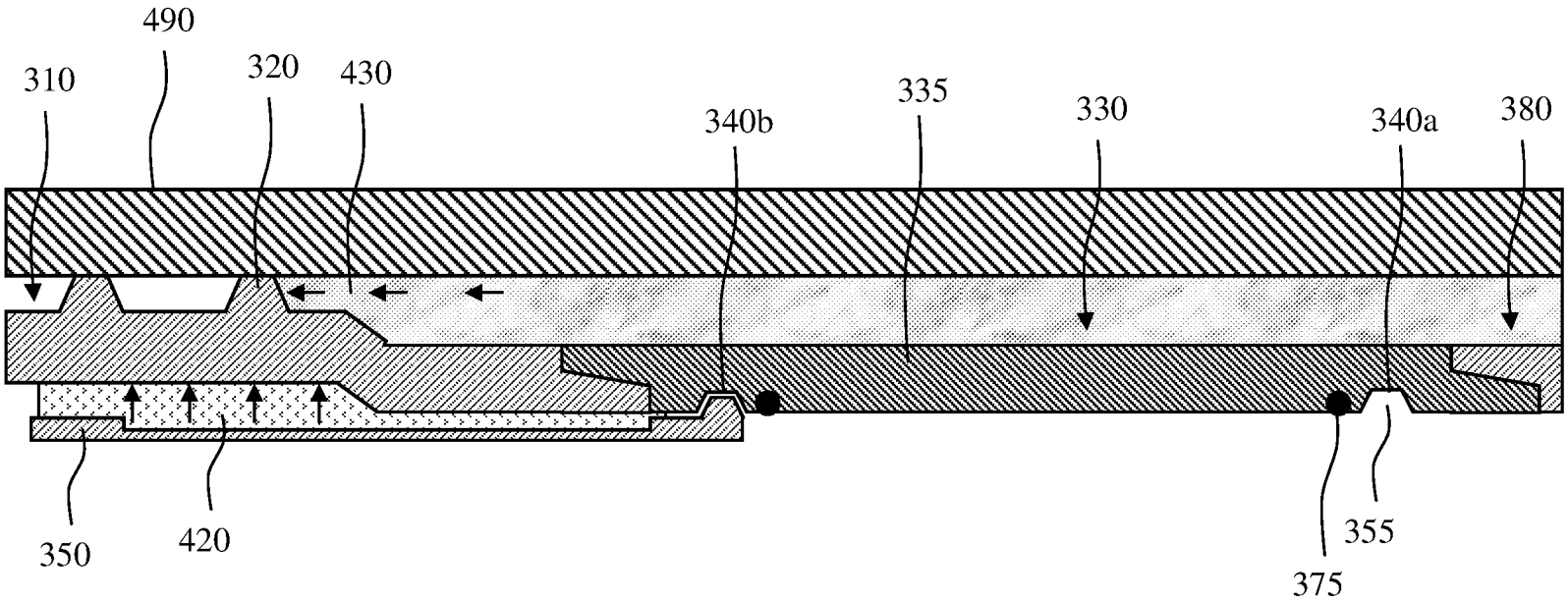

Turning to FIGS. 4A through 4P, illustrated is a method for deploying a liner hanger 400 within a wellbore tubular 490 according to one or more embodiments of the disclosure. The liner hanger 400 is similar, in many respects, to the liner hanger 300 of FIGS. 3A through 3D discussed above. Accordingly, like reference numbers have been used to indicate similar, if not identical, features. The wellbore tubular 490, in one or more embodiments, is a casing string (e.g., similar to the surface casing and/or intermediate casing discussed above with regard to FIGS. 1 and 2). Nevertheless, the wellbore tubular 490 could be any other wellbore tubular that might be found in a well system.

With initial reference to FIGS. 4A and 4B, the liner hanger 400 is being positioned within the wellbore tubular 490 using a running tool 450. The running tool 450, in the illustrated embodiment, includes a running tool profile 455. For example, the running tool profile 455 is engaged with the deployment profile 390 in the deployment body 380, and thus may be used to position the liner hanger 400 at an appropriate location within the wellbore tubular 490. The running tool 450, in the illustrated embodiment, additionally includes an expansion cone 410 positioned between an OD of the running tool 450 and an ID of the liner hanger body 310.

Turning to FIGS. 4C and 4D, illustrated is the liner hanger 400 of FIGS. 4A and 4B after beginning to pressure down on the expansion cone 410. As shown, the expansion cone 410 may engage with a shoulder of the liner hanger body 310, and thus may be used to plastically deform the expansion section 315 of the liner hanger body 310 into engagement with the ID of the wellbore tubular 490.

Turning to FIGS. 4E and 4F, illustrated is the liner hanger 400 of FIGS. 4C and 4D after employing the expansion cone 410 to plastically deform the expansion section 315 of the liner hanger body 310 into the radially expanded state, and thus into engagement (e.g., interference contact) with the ID of the wellbore tubular 490. In the illustrated embodiment, the expansion cone 410 radially expands the one or more sealing elements 320 into radial engagement with the ID of the wellbore tubular 490.

Turning to FIGS. 4G and 4H, illustrated is the liner hanger 400 of FIGS. 4E and 4F after disengaging the running tool profile 455 of the running tool 450 from the liner hanger 400. Accordingly, the running tool 450 may now be pulled uphole. In the illustrated embodiment, the running tool profile 455 (or a dedicated shifting profile or collet) catches on the mechanical support structure 350, as shown. While the embodiment of FIGS. 4G through 4H illustrates the running tool profile 455 catching on the mechanical support structure 350, other embodiments exist wherein a dedicated shifting profile/mechanism within the running tool 450 catches on the mechanical support structure 350.

Turning to FIGS. 4I and 4J, illustrated is the liner hanger 400 of FIGS. 4G and 4H after the running tool 450 continues to be drawn uphole. As shown, the continued movement of the running tool 450 shifts the mechanical support structure 350 from its first position radially misaligned with the expansion section 315 to a second position at least partially radially aligned with the expansion section 315. At this stage, the support structure positioning profile 355 engages with the uphole support housing profile 340*b*, thereby movably fixing the mechanical support structure 350 in the second position. Moreover, at this stage, the one or more seals 375 no longer isolate the expandable metal 370 from reactive fluid that may be located in the wellbore or subsequently displaced within the wellbore.

Turning to FIGS. 4K and 4L, illustrated is the liner hanger 400 of FIGS. 4I and 4J after the running tool 450 continues to be drawn uphole. At this stage, the running tool 450 is completely disengaged from the support assembly 330.

Turning to FIGS. 4M and 4N, illustrated is the liner hanger 400 of FIGS. 4K and 4L after the expandable metal 370 has been subjected to reactive fluid, and thus the expandable metal has expanded in response to hydrolysis (e.g., as discussed above), resulting in an expanded metal support structure 420. In one embodiment, fluid that is already within the wellbore acts as the reactive fluid. In yet another embodiment, reactive fluid may be circulated into the wellbore using one or more different service tools (e.g., including the running tool 450 itself).

The expanded metal support structure 420, in the illustrated embodiment, is at least partially radially aligned with the plastically deformed expansion section 315. In the illustrated embodiment, the expanded metal support structure 420 is radially aligned with two of the series of sealing elements 320. Nevertheless, as discussed above, the liner hanger 400 may be designed to radially align the expanded metal support structure 420 with one or more of the series of sealing elements 320 and remain within the scope of the disclosure.

Turning to FIGS. 4O and 4P, illustrated is the liner hanger 400 of FIGS. 4M and 4N after high pressure fluid 430 (e.g., downhole fluid) impinges upon the one or more sealing elements 320. As shown, the expanded metal support structure 420 helps maintain the contact pressure of the one or more sealing elements 320 with the ID of the wellbore tubular 490, and thus prevents the high pressure fluid 430 from traversing uphole of the one or more sealing elements 320. Aspects disclosed herein include:

A. A liner hanger for suspending a liner, the liner hanger including: 1) a liner hanger body, the liner hanger body having an expansion section configured to move from a radially unexpanded state to a radially expanded state in contact with an inside diameter (ID) of a wellbore tubular; and 2) a support assembly coupled to the liner hanger body, the support assembly including: a) a support housing; b) a mechanical support structure positioned radially inside of the support housing, the mechanical support structure movable from a first position radially misaligned with the expansion section when the expansion section is in the radially unexpanded state to a second position at least partially radially aligned with the expansion section when the expansion section is in the radially expanded state; and c) expandable metal coupled to the mechanical support structure, the expandable metal configured to expand in response to hydrolysis to contact an inside diameter (ID) of the liner hanger body when the mechanical support structure is in the second position, and thereby provide mechanical support to at least a portion of the expansion section in the radially expanded state.

B. A method, the method including: 1) positioning a liner hanger in a wellbore tubular located in a wellbore, the liner hanger including: a) a liner hanger body, the liner hanger body having an expansion section configured to move from a radially unexpanded state to a radially expanded state in contact with an inside diameter (ID) of the wellbore tubular; and b) a support assembly coupled to the liner hanger body, the support assembly including: i) a support housing; ii) a mechanical support structure positioned radially inside of the support housing, the mechanical support structure movable from a first position radially misaligned with the expansion section when the expansion section is in the radially unexpanded state to a second position at least partially radially aligned with the expansion section when the expansion section is in the radially expanded state; and iii) expandable metal coupled to the mechanical support structure, the expandable metal configured to expand in response to hydrolysis to contact an inside diameter (ID) of the liner hanger body when the mechanical support structure is in the second position, and thereby provide mechanical support to at least a portion of the expansion section in the radially expanded state; 2) plastically deforming the expansion section into the radially expanded state; and 3) moving the mechanical support structure from the first position to the second position at least partially radially aligned with the plastically deformed expansion section.

C. A well system, the well system including: 1) a wellbore; 2) a wellbore tubular located within the wellbore; and 3) a liner hanger engaged with the wellbore tubular, the liner hanger including: a) a liner hanger body, the liner hanger body having a plastically deformed expansion section in a radially expanded state in contact with an inside diameter (ID) of the wellbore tubular; and b) a support assembly coupled to the liner hanger body, the support assembly including: i) a support housing; ii) a mechanical support structure positioned radially inside of the support housing, the mechanical support structure at least partially radially aligned with the plastically deformed expansion section; and iii) an expanded metal support structure at least partially radially aligned with the plastically deformed expansion section.

Aspects A, B, and C may have one or more of the following additional elements in combination: Element 1: wherein the expansion section has one or more sealing elements positioned radially thereabout, the one or more sealing elements configured to contact the inside diameter (ID) of the wellbore tubular when the expansion section moves to the radially expanded state. Element 2: wherein the first position of the mechanical support structure is radially misaligned with the one or more sealing elements, and the second position of the mechanical support structure is radially aligned with at least one of the one or more sealing elements. Element 3: wherein the first position of the mechanical support structure is radially misaligned with the one or more sealing elements, and the second position of the mechanical support structure is radially aligned with at least two of the one or more sealing elements. Element 4: wherein the first position of the mechanical support structure is radially misaligned with the one or more sealing elements, and the second position of the mechanical support structure is radially aligned with all of the one or more sealing elements. Element 5: further including one or more seals positioned radially between the support housing and the mechanical support structure, the one or more seals configured to isolate the expandable metal from reactive fluid when the mechanical support structure is in the first position. Element 6: wherein the mechanical support structure includes a support structure positioning profile, the support structure positioning profile configured to engage with one or more support housing profiles when the mechanical support structure is in the first position or the second position. Element 7: wherein the support housing has a downhole support housing profile and an uphole support housing profile, and further wherein the support structure positioning profile is configured to engage with the downhole support housing profile when the mechanical support structure is in the first position and then slide to engage with the uphole support housing profile when the mechanical support structure is in the second position. Element 8: wherein a recess is formed in an outside diameter (OD) of the mechanical support structure, and further wherein the expandable metal is located in the recess. Element 9: wherein the mechanical support structure is radially misaligned with an entirety of the liner hanger body when in the first position. Element 10: further including a deployment body coupled with the liner hanger body. Element 11: wherein the support assembly is positioned between the liner hanger body and the deployment body. Element 12: wherein the deployment body includes a deployment profile configured to engage with a running tool profile of a running tool, and further wherein the mechanical support structure is moveable from the first position to the second position as the running tool profile is moved uphole. Element 13: further including subjecting the expandable metal to reactive fluid when the mechanical support structure is in the second position, thereby forming an expanded metal support structure at least partially radially aligned with the plastically deformed expansion section. Element 14: wherein the expansion section has one or more scaling elements positioned radially thereabout, and further wherein plastically deforming the expansion section includes plastically deforming the expansion section to cause the one or more sealing elements to contact the inside diameter (ID) of the wellbore tubular. Element 15: wherein the deployment body includes a deployment profile, and further wherein positioning the liner hanger in the wellbore tubular includes positioning the liner hanger in the wellbore tubular with a running tool having a running tool profile engaged with the deployment profile. Element 16: wherein moving the mechanical support structure from the first position to the second position includes pulling the running tool having the running tool profile uphole, the running tool profile engaging with the mechanical support structure to move the mechanical support structure from the first position to the second position. Element 17: wherein the expanded metal support structure is located radially between the plastically deformed expansion section and the mechanical support structure. Element 18: further including a liner coupled to a downhole end of the liner hanger. Element 19: wherein the plastically deformed expansion section has one or more sealing elements positioned radially thereabout and in contact with the inside diameter (ID) of the wellbore tubular. Element 20: wherein the mechanical support structure is radially aligned with at least one of the one or more sealing elements. Element 21: wherein the mechanical support structure is radially aligned with at least two of the one or more sealing elements. Element 22: wherein the mechanical support structure is radially aligned with all of the one or more sealing elements. Element 23: wherein a recess is formed in an outside diameter (OD) of the mechanical support structure, and further wherein the expanded metal support structure is located in the recess. Element 24: further including a deployment body coupled with the liner hanger body. Element 25: wherein the support assembly is positioned between the liner hanger body and the deployment body.

Those skilled in the art to which this application relates will appreciate that other and further additions, deletions, substitutions and modifications may be made to the described embodiments.

What is claimed is:

1. A liner hanger for suspending a liner, the liner hanger comprising:

a liner hanger body, the liner hanger body having an expansion section configured to move from a radially unexpanded state to a radially expanded state in contact with an inside diameter (ID) of a wellbore tubular; and a support assembly coupled to the liner hanger body, the support assembly including:

a support housing;

a mechanical support structure positioned radially inside of the support housing, the mechanical support structure movable from a first position radially misaligned with the expansion section when the expansion section is in the radially unexpanded state to a second position at least partially radially aligned with the expansion section when the expansion section is in the radially expanded state; and expandable metal coupled to the mechanical support structure, the expandable metal configured to expand in response to hydrolysis to contact an inside diameter (ID) of the liner hanger body when the mechanical support structure is in the second position, and thereby provide mechanical support to at least a portion of the expansion section in the radially expanded state.

2. The liner hanger as recited in claim 1, wherein the expansion section has one or more sealing elements positioned radially thereabout, the one or more sealing elements configured to contact the inside diameter (ID) of the wellbore tubular when the expansion section moves to the radially expanded state.

3. The liner hanger as recited in claim 2, wherein the first position of the mechanical support structure is radially misaligned with the one or more sealing elements, and the second position of the mechanical support structure is radially aligned with at least one of the one or more sealing elements.

4. The liner hanger as recited in claim 2, wherein the first position of the mechanical support structure is radially misaligned with the one or more sealing elements, and the second position of the mechanical support structure is radially aligned with at least two of the one or more sealing elements.

5. The liner hanger as recited in claim 2, wherein the first position of the mechanical support structure is radially misaligned with the one or more sealing elements, and the second position of the mechanical support structure is radially aligned with all of the one or more sealing elements.

6. The liner hanger as recited in claim 1, further including one or more seals positioned radially between the support housing and the mechanical support structure, the one or more seals configured to isolate the expandable metal from reactive fluid when the mechanical support structure is in the first position.

7. The liner hanger as recited in claim 1, wherein the mechanical support structure includes a support structure positioning profile, the support structure positioning profile configured to engage with one or more support housing profiles when the mechanical support structure is in the first position or the second position.

8. The liner hanger as recited in claim 7, wherein the support housing has a downhole support housing profile and an uphole support housing profile, and further wherein the support structure positioning profile is configured to engage with the downhole support housing profile when the mechanical support structure is in the first position and then slide to engage with the uphole support housing profile when the mechanical support structure is in the second position.

9. The liner hanger as recited in claim 1, wherein a recess is formed in an outside diameter (OD) of the mechanical support structure, and further wherein the expandable metal is located in the recess.

10. The liner hanger as recited in claim 1, wherein the mechanical support structure is radially misaligned with an entirety of the liner hanger body when in the first position.

11. The liner hanger as recited in claim 1, further including a deployment body coupled with the liner hanger body.

12. The liner hanger as recited in claim 11, wherein the support assembly is positioned between the liner hanger body and the deployment body.

13. The liner hanger as recited in claim 12, wherein the deployment body includes a deployment profile configured to engage with a running tool profile of a running tool, and further wherein the mechanical support structure is moveable from the first position to the second position as the running tool profile is moved uphole.

14. A method, comprising:

positioning a liner hanger in a wellbore tubular located in a wellbore, the liner hanger including:

a liner hanger body, the liner hanger body having an expansion section configured to move from a radially unexpanded state to a radially expanded state in contact with an inside diameter (ID) of the wellbore tubular; and a support assembly coupled to the liner hanger body, the support assembly including:

a support housing;

a mechanical support structure positioned radially inside of the support housing, the mechanical support structure movable from a first position radially misaligned with the expansion section when the expansion section is in the radially unexpanded state to a second position at least partially radially aligned with the expansion section when the expansion section is in the radially expanded state; and expandable metal coupled to the mechanical support structure, the expandable metal configured to expand in response to hydrolysis to contact an inside diameter (ID) of the liner hanger body when the mechanical support structure is in the second position, and thereby provide mechanical support to at least a portion of the expansion section in the radially expanded state;

plastically deforming the expansion section into the radially expanded state; and moving the mechanical support structure from the first position to the second position at least partially radially aligned with the plastically deformed expansion section.

15. The method as recited in claim 14, further including subjecting the expandable metal to reactive fluid when the mechanical support structure is in the second position, thereby forming an expanded metal support structure at least partially radially aligned with the plastically deformed expansion section.

16. The method as recited in claim 14, wherein the expansion section has one or more sealing elements positioned radially thereabout, and further wherein plastically deforming the expansion section includes plastically deforming the expansion section to cause the one or more sealing elements to contact the inside diameter (ID) of the wellbore tubular.

17. The method as recited in claim 16, wherein the first position of the mechanical support structure is radially misaligned with the one or more sealing elements, and the second position of the mechanical support structure is radially aligned with at least one of the one or more sealing elements.

18. The method as recited in claim 16, wherein the first position of the mechanical support structure is radially misaligned with the one or more sealing elements, and the second position of the mechanical support structure is radially aligned with at least two of the one or more sealing elements.

19. The method as recited in claim 16, wherein the first position of the mechanical support structure is radially misaligned with the one or more sealing elements, and the second position of the mechanical support structure is radially aligned with all of the one or more sealing elements.

20. The method as recited in claim 14, further including one or more seals positioned radially between the support housing and the mechanical support structure, the one or more seals configured to isolate the expandable metal from reactive fluid when the mechanical support structure is in the first position.

21. The method as recited in claim 14, wherein the mechanical support structure includes a support structure positioning profile, the support structure positioning profile configured to engage with one or more support housing profiles when the mechanical support structure is in the first position or the second position.

22. The method as recited in claim 21, wherein the support housing has a downhole support housing profile and an uphole support housing profile, and further wherein the support structure positioning profile is configured to engage with the downhole support housing profile when the mechanical support structure is in the first position and then slide to engage with the uphole support housing profile when the mechanical support structure is in the second position.

23. The method as recited in claim 14, wherein a recess is formed in an outside diameter (OD) of the mechanical support structure, and further wherein the expandable metal is located in the recess.

24. The method as recited in claim 14, wherein the mechanical support structure is radially misaligned with an entirety of the liner hanger body when in the first position.

25. The method as recited in claim 14, further including a deployment body coupled with the liner hanger body.

26. The method as recited in claim 25, wherein the support assembly is positioned between the liner hanger body and the deployment body.

27. The method as recited in claim 26, wherein the deployment body includes a deployment profile, and further wherein positioning the liner hanger in the wellbore tubular includes positioning the liner hanger in the wellbore tubular with a running tool having a running tool profile engaged with the deployment profile.

28. The method as recited in claim 27, wherein moving the mechanical support structure from the first position to the second position includes pulling the running tool having the running tool profile uphole, the running tool profile engaging with the mechanical support structure to move the mechanical support structure from the first position to the second position.

29. A well system, comprising:

a wellbore;

a wellbore tubular located within the wellbore; and a liner hanger engaged with the wellbore tubular, the liner hanger including:

a liner hanger body, the liner hanger body having a plastically deformed expansion section in a radially expanded state in contact with an inside diameter (ID) of the wellbore tubular; and a support assembly coupled to the liner hanger body, the support assembly including:

a support housing;

a mechanical support structure positioned radially inside of the support housing, the mechanical support structure at least partially radially aligned with the plastically deformed expansion section; and an expanded metal support structure at least partially radially aligned with the plastically deformed expansion section.

30. The well system as recited in claim 29, wherein the expanded metal support structure is located radially between the plastically deformed expansion section and the mechanical support structure.

31. The well system as recited in claim 29, further including a liner coupled to a downhole end of the liner hanger.

32. The well system as recited in claim 29, wherein the plastically deformed expansion section has one or more sealing elements positioned radially thereabout and in contact with the inside diameter (ID) of the wellbore tubular.

33. The well system as recited in claim 32, wherein the mechanical support structure is radially aligned with at least one of the one or more sealing elements.

34. The well system as recited in claim 32, wherein the mechanical support structure is radially aligned with at least two of the one or more sealing elements.

35. The well system as recited in claim 32, wherein the mechanical support structure is radially aligned with all of the one or more sealing elements.

36. The well system as recited in claim 29, wherein a recess is formed in an outside diameter (OD) of the mechanical support structure, and further wherein the expanded metal support structure is located in the recess.

37. The well system as recited in claim 29, further including a deployment body coupled with the liner hanger body.

38. The well system as recited in claim 37, wherein the support assembly is positioned between the liner hanger body and the deployment body.

* * * * *